US005214969A

United States Patent [19]

Adkins et al.

[11] Patent Number: 5,214,969

[45] Date of Patent: Jun. 1, 1993

[54] AUTOMATIC TESTING OF A PLURALITY OF SMOKING ARTICLES

[75] Inventors: Wayne B. Adkins, New Kent; Charles T. Higgins, Richmond; Hugh J. McCafferty, Richmond; Edgar L. Moss, Richmond; Jose I. Roncero, Richmond, all of Va.

[73] Assignee: Philip Morris Incorporated, New York, N.Y.

[21] Appl. No.: 657,677

[22] Filed: Feb. 19, 1991

[51] Int. Cl.[5] ..... G01N 33/483

[52] U.S. Cl. ..... 73/866; 73/38; 73/865.8; 83/931; 131/908; 414/224; 414/225; 901/39

[58] Field of Search ..... 73/866, 432.1, 865.8, 73/865.9, 38, 37.8; 131/904, 905, 906, 908, 248, 250; 83/522.26, 931; 414/225, 226, 224; 901/31, 39, 44, 46; 198/339.1

[56] References Cited

U.S. PATENT DOCUMENTS

| | | | |
|---|---|---|---|
| 2,016,156 | 10/1935 | Neumair | 414/226 |
| 3,039,589 | 6/1962 | Molins et al. | 198/803.5 X |
| 3,150,390 | 9/1964 | Klooz | 414/226 X |
| 3,501,023 | 3/1970 | Seragnoli | 414/225 X |
| 3,595,067 | 7/1971 | Von Der Lohe | 73/37.6 |
| 3,732,874 | 5/1973 | Wagner et al. | 73/23.31 X |
| 3,850,029 | 11/1974 | Swanson | 73/81 |
| 3,985,252 | 10/1976 | Hinchcliffe et al. | 198/454 X |
| 4,177,670 | 12/1979 | Heitmann et al. | 73/38 |
| 4,181,007 | 1/1980 | Arisaka et al. | 73/37.8 |
| 4,289,441 | 9/1981 | Inaba et al. | 414/589 |
| 4,355,535 | 10/1982 | Vaughan | 73/37.8 |
| 4,403,620 | 9/1983 | Joseph et al. | 131/280 |
| 4,448,079 | 5/1984 | Schumacher et al. | 73/78 X |
| 4,480,463 | 11/1984 | Schumacher et al. | 73/38 |
| 4,483,349 | 11/1984 | Dyett et al. | 131/94 |
| 4,637,564 | 1/1987 | Hallenbeck et al. | 242/25 A |
| 4,639,592 | 1/1987 | Heitmann | 250/223 B |
| 4,708,574 | 11/1987 | Conboy et al. | 414/591 |
| 4,821,972 | 4/1989 | Grollimund et al. | 242/56 R |
| 4,882,938 | 11/1989 | Neri | 73/863.91 |
| 4,901,860 | 2/1990 | Wahle et al. | 209/535 |
| 4,911,028 | 3/1990 | Stevens | 73/866 |
| 4,911,374 | 3/1990 | Grollimund et al. | 242/56 R |

FOREIGN PATENT DOCUMENTS

| | | | |
|---|---|---|---|
| 2545410 | 11/1984 | France | 198/339.1 |
| 638614 | 9/1983 | Switzerland | 131/904 |
| 1316788 | 6/1987 | U.S.S.R. | 414/226 |

*Primary Examiner*—Tom Noland

[57] ABSTRACT

A flexible automatic test facility for measuring physical parameters of smoking articles and components of smoking articles, e.g., filter portions. The test facility includes a microprocessor based controller device, apparatus for severing the filter portion from the article, a plurality of instruments for performing the desired measurements and a computer-controlled robot for gripping and maneuvering one cigarette at a time to one or more of the instruments or severing apparatus to measure one or more physical characteristics of each article or its components in accordance with software instructions. A hopper feeder device containing a plurality of sample sets in separate bins in an indexing mechanism may be provided for extended unattended operation. Each sample set is provided with a code and a database including the nominal physical characteristics of the samples in the set and the test sequence for the cigarettes in the sample set. The test sequence and parameters for each article in each set are obtained from the database, and the controller instructs the robot to grip a fed cigarette and to advance that cigarette to one or more of the instruments for performing measurements or processing station for severing filter in accordance with the predetermined sequence of measurements. At the conclusion of the samples in a given sample set, the next sample set is loaded, identified, and the process continues in accordance with the predetermined sequence for that sample set.

34 Claims, 11 Drawing Sheets

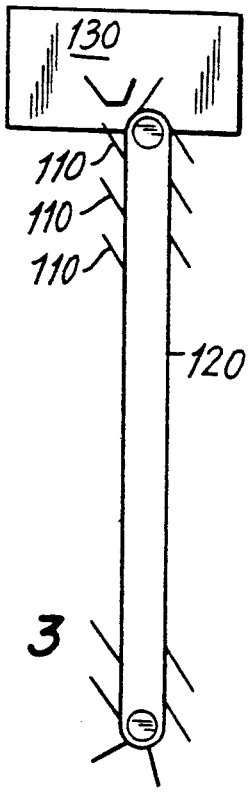
FIG. 3
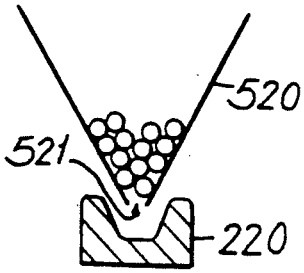
FIG. 5
FIG. 4
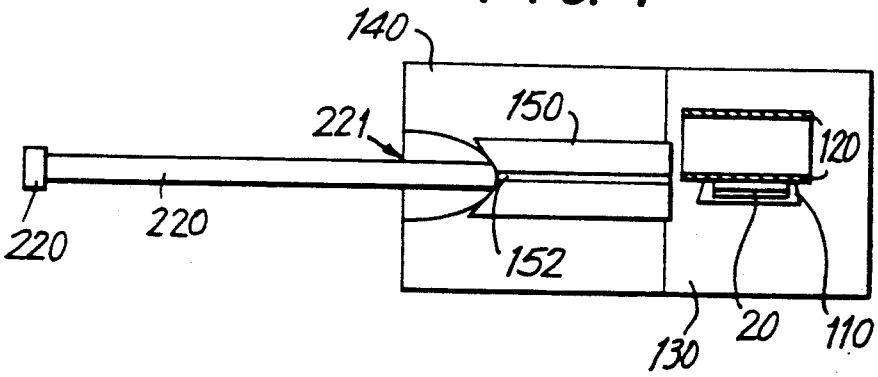
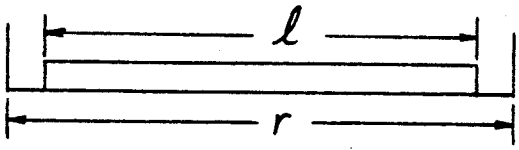
FIG. 6
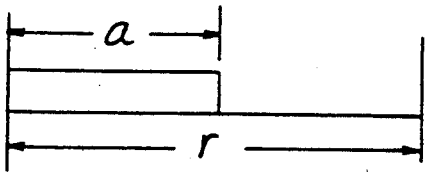
FIG. 7

503
381
340
382
500
350
379
520
379
362
361
370
363
374
368
360
369
367
450
330
20
365
375
364
377
378
12

AUTOMATIC TESTING OF A PLURALITY OF SMOKING ARTICLES

BACKGROUND OF THE INVENTION

This invention relates to an automatic test station for handling bundles of smoking articles and performing one or more of a plurality of physical measurements on individual smoking articles and components thereof. More particularly, this invention relates to an automatic test station having a plurality of measuring stations and a robotic device for maneuvering differently dimensioned smoking articles to one or more of the measuring stations in a preselected sequence in an unattended mode.

It is common practice to perform a sequence of one or more tests or measurements on commercial and experimental smoking articles and their component parts following assembly. These measurements include the physical characteristics of the article and component parts (e.g., the filter) such as article pressure drop, ventilation, filter pressure drop, article circumference, article length, filter length, filter and tobacco weights, and paper permeability. A plurality of like smoking articles are subjected to tests that measure one or more of those specific properties. The test results may be used to evaluate the uniformity of the measured property or properties from article to article within the plurality of like articles and to obtain statistical data regarding the characteristics of the like articles in that plurality of articles. In addition, multiple pluralities of like articles, wherein the articles in each plurality may be different, are typically subjected to the same series of tests under conditions that permit comparing the statistical characteristics of the different like articles.

Tests may be performed both on the complete article and separately on components of a complete article. For example, the filter portion of a filter-tipped smoking article may be measured for pressure drop, circumference and size. This requires that the filter be severed from the smoking article. Any tobacco shreds that remain affixed to the filter are removed from the filter portion.

In conventional testing, a series of conventional test instruments are arranged in a work area. An operator manually places each smoking article, or its component, into each instrument and actuates the instrument to conduct the desired measurement. The test result, i.e., the measured parameter is then displayed on the instrument and the data are typically transmitted to a host computer for recordation in a database. The database is used for subsequent analysis and tabulation. To measure component parts, the operator must manually sever the component from the article, dispose of the remainder of the article (or save it for subsequent testing), and then insert the component into the proper instrument or instruments to acquire the desired measurements. For example, to conduct tests on the filter rod portion of a conventional cigarette, the filter rod is typically severed from the cigarette using a razor blade to cut through the tobacco portion, and any tobacco shreds remaining attached to the filter are removed by the operator using a small instrument or a finger. The cleaned or deshredded filter is then inserted into the measuring instruments and the data acquired.

One problem with this technique is that it requires an operator to be in attendance throughout the procedure. Tests on manually guided articles also may be subject to variations in how or where the smoking article is gripped and/or positioned during the measurement procedure. These variations are undesirable for obtaining accurate statistical data.

Fidus-Instrument Corporation, Richmond, Va., has available a product line under the trade name Automatic Test Stations. The automatic test stations provide combinations of instruments for measuring one or more of weight, circumference/diameter, ventilation, pressure drop, and hardness. Model numbers CTS 500, CTS 400, CTS 350, and CTS 300 are automatic test stations for testing only cigarettes. Model numbers FTS 400 and FTS 300 are automatic test stations for testing only filter rod portions. The different numerical designations indicate that different combinations of instruments for performing various measurements are combined into a single CTS or FTS station. The measuring units are stacked on top of each other so that each article or filter rod to be tested is downwardly and sequentially indexed along an axis through the instruments.

The automatic test stations are available in conjunction with a product under the trade name Automatic Hopper Loader, model number AHL 100, also available from Fidus Instrument Corp. The Automatic Hopper Loader device has a plurality of bins for receiving bundles of a plurality of smoking articles (or filter rods) that may be loaded with up to eighteen bundles of smoking articles (or filter rods) simultaneously. The commercial hopper device transfers the contents of one bin to a hopper area. The contents loaded in the hopper area are then fed, one at a time, into either a CTS or FTS device, to which the hopper is mated. The bins are then indexed to bring the next bin into position for unloading into the hopper. The CTS and FTS automatic test station devices are capable of providing the results of the acquired test data to a master computer for tabulation and recordation.

One problem with these prior commercial devices is that they are not sufficiently flexible to alter the test sequence of individual samples among each bundle or from bundle to bundle. Rather, each model Automatic Test Station is configured with a sufficiently broad number of tests which are performed on each smoking article or filter rod fed into the Station. Thus, unnecessary tests are performed. Also, if one instrument module in a station becomes inoperative, the entire station becomes inoperative until that module can be repaired or replaced.

Another problem with these prior devices is that they are not capable of performing tests on a selected smoking article, followed by performing tests on a component of that smoking article, for example, the filter rod portion. Rather, a second Automatic Test Station of the FTS series must be obtained, in addition to a CTS series station, and an operator must manually sever the filter from the smoking articles measured by the CTS station and insert the severed filters into the FTS station for the filter measurements.

It is known to use robotic devices having opposing members for grasping and maneuvering objects from one location to another for assembling structures and for preparation of samples, e.g., dilution or mixing of chemical materials, prior to introduction to an analytical instrument in an analytical laboratory. One such device is the MasterLab TM System available from Perkins-Elmer Corp., Norwalk, Conn. 06856. However, it is not known to use such devices for gripping and maneuvering a plurality of different smoking articles. One of the problems with such robotic systems is that they are not readily capable of grasping differently dimensioned crushable, nonresilient objects such as smoking articles without damaging at least some, if not all, of such articles. More particularly, such robotic devices typically do not have the ability to grasp securely a preselected range of differently dimensioned smoking articles without deforming at least some articles in the range. The use of force transducers to monitor the forces exerted to control gripping of the article has been considered. However, such transducers increase the cost and complexity of the device. Also, because such transducers monitor force, they do not detect whether the deformable article is securely gripped and not deformed or damaged. Thus, such force transducers are not likely to prevent the opposing members from damaging relatively fragile smoking articles.

Accordingly, there is a continuing need for automatic test stations that are flexible in operation and can be programmed to perform a desired series of tests of measurements. Further, there is a need for such automatic test station that can operate in an unattended mode.

It is, therefore, an object of this invention to provide an automated test station for obtaining one or more measurements on a smoking article selected from among a plurality of possible measurements. It is another object to provide a programmable automated test station for conducting different tests on different smoking articles in an unattended mode. It is another object to provide an automated test station that can conduct measurement tests on multiple sets of samples consecutively in an unattended mode.

It is another object of this invention to provide an automatic test station that can perform a selected sequence of characterization measurements on a smoking article and on a component of that article. It is another object to provide a robotic device for gripping and maneuvering each smoking article and smoking article component.

It is another object of this invention to provide an automated test station that can be instructed to conduct different test protocols on different samples within a sample set and on samples within different sample sets.

It is another object of this invention to provide an automated test station that can conduct measurement tests using conventional measuring instruments with minimal modification. It is another object to provide a test station that can be manually operated when necessary or desirable.

It is another object of this invention to provide an automated test station that can communicate with a computer device to receive information regarding the tests to be conducted and to transfer data for subsequent evaluation.

SUMMARY OF THE INVENTION

In accordance with the present invention, a computer-controlled robotic automatic test station that measures a selected number of a plurality of physical parameters of smoking articles and/or smoking article components in a selected sequence is provided.

One aspect of the present invention is directed to an apparatus for measuring a physical characteristic of a plurality of smoking articles. One such apparatus comprises:

means for gripping and releasing a smoking article;

means for maneuvering a gripped smoking article within a range of motion;

means for receiving one of said plurality of smoking articles at a first location within the range of motion;

means for measuring a physical characteristic of a smoking article, the measuring means being at a second location within the range of motion; and means for controlling the gripping and releasing means and the maneuvering means to grip the one smoking article at the first location and to maneuver the one smoking article to the measuring means so that the physical characteristic of the one smoking article can be measured.

In one embodiment, the controlling means is a microprocessor which controls the gripping and releasing means to release the one smoking article at the measuring means so that the physical characteristic can be measured and to grip the one smoking article at the measuring means following the measurement. Preferably, the gripping and releasing means and the maneuvering means are a robot having a first member and a second member, the first and second members being movable in opposition for gripping therebetween a smoking article.

In a preferred embodiment of such an apparatus, the measuring means further comprises a first means for measuring a first physical characteristic of a smoking article located at the second location and a second means for measuring a second physical characteristic of a smoking article, the second measuring means being located at a third location within the range of motion, and wherein the controlling means controls the gripping and releasing means and the maneuvering means to grip the one smoking article at the first location and to maneuver the one smoking article to one of the first and second measuring means whereby one of the first and second physical characteristics can be measured. The controlling means preferably also controls the gripping and releasing means and the maneuvering means to maneuver the one smoking article from the one of the first and second measuring stations to the other of the first and second measuring means whereby the other of the first and second physical characteristics can be measured.

In an alternate preferred embodiment of such an apparatus, the measuring means further comprises more than one means for measuring more than one selected physical characteristics of a smoking article wherein each said means is located at a different location within the range of motion and measures a different physical characteristic, said means being selected from among the group consisting of means for measuring circumference, means for measuring pressure drop and means for measuring length, and for filter-tipped smoking articles, means for measuring ventilation, and wherein the controlling means controls the gripping and releasing means and the maneuvering means to maneuver the one smoking article to one or more of the measuring means. The controlling means preferably further comprises a means for providing a test sequence identifying one or more physical characteristics of the one smoking article to be measured, wherein the controlling means is responsive to the test sequence and controls the gripping and releasing means and the maneuvering means to maneuver the gripped one smoking article to one or more of the measuring means so that the one or more identified physical characteristics can be measured. In a preferred embodiment, the test sequence identifies the order in which the measurements of the one smoking article are to be made, and more preferably the order in which the measurements of each smoking article in the plurality of smoking articles are to be made.

Another aspect of the present invention is directed toward an apparatus for measuring a physical characteristic of a component of a plurality of smoking articles. One such apparatus includes:

means for gripping and releasing a smoking article;

means for maneuvering a gripped smoking article within a range of motion;

means for receiving one of said plurality of smoking articles at a first location within the range of motion;

means for severing the component of the smoking article from the smoking article, the severing means being located at a second location within the range of motion;

means for measuring a physical characteristic of a smoking article component, the measuring means being at a third location within the range of motion; and means for controlling the gripping and releasing means and the maneuvering means to grip the one smoking article at the first location and maneuver the one smoking article to the severing means, and to maneuver the one smoking article component to the measuring means so that the physical characteristic of the one smoking article component can be measured.

In one embodiment, the controlling means is a microprocessor which controls the gripping and releasing means to grip the one smoking article by its component, release the one smoking article component at the measuring means so that the physical characteristic of the one smoking article component can be measured, and grip the one smoking article component at the first measuring means following the measurement. Preferably, the gripping and releasing means and the maneuvering means are a robot having a first member and a second member, the first and second members being movable in opposition for gripping therebetween a smoking article.

In a preferred embodiment of such an apparatus, the measuring means comprises a first measuring means for measuring a first physical characteristic of a smoking article component located at the third location and a second means for measuring a second physical characteristic of a smoking article component, the second measuring means being located at a fourth location within the range of motion, and wherein the controlling means controls the gripping and releasing means and the maneuvering means to grip and maneuver the one smoking article component to one of the first and second measuring means whereby one of the first and second physical characteristics can be measured. The controlling means preferably controls the gripping and releasing means and the maneuvering means to maneuver the one smoking article component from the one of the first and second measuring stations to the other of the first and second measuring means whereby the other of the first and second physical characteristics of the smoking article component can be measured. The first and second measuring means are preferably selected from among the group consisting of means for measuring ventilation, means for measuring pressure drop, and means for measuring length.

In an alternate preferred embodiment of such an apparatus, the measuring means further comprises a first means for measuring a first physical characteristic of a smoking article component and a second means for measuring a second physical characteristic of a smoking article, the second measuring means being at a fourth location within the range of motion, wherein the controlling means controls the gripping and releasing means and the maneuvering means to grip the one smoking article at the first location, to maneuver the one smoking article to the second measuring means so that the first physical characteristic of the one smoking article can be measured, and then to the severing means, thereby to sever the component, and to maneuver the one smoking article component to the first measuring means so that the first physical characteristic of the one smoking article component can be measured.

Alternately, the first measuring means further comprises more than one means for measuring more than one physical characteristic of a smoking article component at more than one location in the range of motion, the second measuring means further comprises more than one means for measuring more than one physical characteristic of a smoking article located at more than one location in the range of motion, and the controlling means further comprises a means for providing a test sequence identifying one or more physical characteristics of the one smoking article and one or more physical characteristics of the one smoking article component to be measured, wherein the controlling means is responsive to the provided test sequence and controls the gripping and releasing means and the maneuvering means to maneuver the gripped one smoking article to one or more of the second measuring means, and the severing means, and one or more of the first measuring means so that the one or more identified physical characteristics of the smoking article and the smoking article component can be measured. The test sequence may identify the order in which the measurements of the one smoking article component are to be made and more preferably the order in which the measurements of each smoking article component of the plurality of smoking article are to be made. The physical characteristics of a smoking article are obtained prior to the physical characteristics of a smoking article component.

In one embodiment, the apparatus includes a second means for receiving a smoking article at a fifth location within the range of motion wherein the microprocessor means controls the gripping and releasing means and the maneuvering means to release the one smoking article onto the second receiving means and then to grip the smoking article by its component on the second receiving means, to maneuver the one smoking article to the severing means, and to grip the one smoking article component during the severing process. Preferably, each smoking article component is a filter rod of a cigarette and the apparatus further comprises a means for deshredding the severed filter component of a cigarette, wherein the microprocessor means controls the gripping and releasing means and the maneuvering means to maneuver a severed filter to the deshredding means following the severing operation.

Another aspect of the present invention is directed toward a method for measuring a physical characteristic of a plurality of smoking articles at a test station having a means for gripping and releasing a smoking article, means for maneuvering a gripped smoking article within a range of motion, means for receiving one of said plurality of smoking articles at a first location within the range of motion, means for measuring a physical characteristic of a smoking article, the measuring means being at a second location within the range of motion; and microprocessor means for controlling the gripping and releasing means and the maneuvering means. One such method comprises the steps of providing a plurality of smoking articles;

feeding one fed smoking article to the receiving means;

gripping the one smoking article at the receiving means;

maneuvering the gripped one smoking article to the measuring means; and measuring the physical characteristic of the one smoking article.

In an alternate embodiment the method includes releasing the one smoking article at the measuring means so that the physical characteristic can be measured and gripping the one smoking article at the first measuring means following the measurement.

Preferably, the gripping and releasing means and the maneuvering means are a robot having a first member and a second member movable in opposition, and gripping and releasing the one smoking article further comprises moving the first and second members together for gripping a smoking article and moving the first and second members apart to release the smoking article.

In yet another embodiment, wherein the test station includes more than one means for measuring more than one selected physical characteristics of a smoking article and each said means is located at a different location within the range of motion, said means being selected from among the group consisting of means for measuring circumference, means for measuring pressure drop and means for measuring length, the method further comprises the steps of:

providing a test sequence identifying one or more physical characteristics of the one smoking article to be measured;

gripping and maneuvering the one smoking article to one or more of the measuring means in response to the provided test sequence so that the one or more identified physical characteristics can be measured. Preferably, providing the test sequence further comprises identifying the order in which the measurements of the one smoking article are to be made, and more preferably, identifying the order in which the measurements of each smoking article in the plurality of smoking articles are to be made.

Another aspect of the present invention is directed towards a method for measuring a physical characteristic of a component of a plurality of smoking articles in a test station having means for gripping and releasing a smoking article, means for maneuvering a gripped smoking article within a range of motion, means for receiving one of said plurality of smoking articles at a first location within the range of motion, means for severing the component of a smoking article from the smoking article, the severing means being located at a second location within the range of motion, means for measuring a physical characteristic of a smoking article component, the measuring means being at a third location within the range of motion, and microprocessor means for controlling the gripping and releasing means and the maneuvering means. One such method comprises:

providing a plurality of smoking articles;

feeding one smoking article to the receiving means;

gripping the one fed smoking article by its component;

maneuvering the gripped smoking article to the severing means;

severing the one smoking article component from the one smoking article;

maneuvering the one smoking article component to the measuring means; and measuring the physical characteristic of the one smoking article component.

Optionally, the method further comprises releasing the smoking article component at the measuring means so that the physical characteristic of the one smoking article component can be measured and gripping the one smoking article component at the measuring means following the measurement.

Preferably, the gripping and releasing means and the maneuvering means are a robot having a first member and a second member movable in opposition and the step of gripping the one smoking article or one smoking article component further comprises moving the first and second members together and the step of releasing the one smoking article component further comprises moving the first and second members apart.

In one preferred embodiment, the measuring means further comprises one or more means for measuring one or more physical characteristics of a smoking article component selected from among the group consisting of means for measuring ventilation, means for measuring pressure drop and means for measuring length, and one or more means for measuring one or more physical characteristics of a smoking article, each measuring means being located at a different location within the range of motion, wherein the method further comprises:

providing a test sequence identifying one or more of the physical characteristics of the one smoking article and the one smoking article component to be measured;

gripping and releasing and maneuvering the one smoking article to one or more of the measuring means and the severing station in response to the identified sequence so that the one or more of the identified physical characteristics of the one smoking article and the one smoking article component can be measured.

Preferably, providing the test sequence further comprises identifying the order in which the measurements of the one smoking article and the one smoking article component are to be made, and more preferably the order in which the measurements of each smoking article and smoking article component of the plurality of smoking articles are to be made.

In one preferred embodiment, the test station includes a second means for receiving a smoking article at a fourth location within the range of motion and the step of maneuvering the gripped one smoking article to the severing means further comprises:

maneuvering the gripped article to the second receiving means, releasing the one smoking article on the second receiving means;

gripping the one smoking article component while the article is on the second receiving means; and maneuvering the one smoking article to the severing means so that the gripping means grips the one smoking article component during the severing process.

Preferably, the smoking article and its component further comprise a tobacco-containing cigarette and a filter tip and the method further comprises:

maneuvering the gripped filter severed from the cigarette to a means for deshredding the filter of any tobacco prior to measuring the physical characteristic of the filter, the deshredding means being at a fifth location in the range of motion.

In one aspect, the invention concerns providing a robot, a system microprocessor controller, a selected number of existing laboratory measuring instruments, and a smoking article severing station. The microprocessor device controls the robot, instruments, and severing station so that each article or component to be tested is maneuvered through a predetermined sequence of tests. A hopper feeder device may be provided so that several sets of samples can be loaded at one time into separate bins in that device whereby each sample set is identified with a code and the physical parameters of the samples in each set are enumerated and assigned to that code. In addition, the sequence of the tests to be run on the samples in the set and which tests are to be run on which samples are established in a database that is associated with the code. Thus, when a bin of samples is to be processed, the code is read and the appropriate database parameters are incorporated into the instructions to the robot so that samples are properly maneuvered into the proper position for conducting the selected measurements to be performed in the selected sequence.

In operation, the system controller instructs the hopper-feeder to unload one hopper-bin containing a sample set into a feeder device and to feed one article from that set at a time. The system controller reads the code associated with that bin and sample set and adjusts the instructions to be delivered to the robot to account for the parameters of the samples to be measured and the tests sequence to be conducted. The system controller then instructs the robot to grip an article and place it into the selected test instruments in the selected sequence, to obtain the test results and data, optionally to print the data, and preferably to transmit the acquired data to a host computer for further processing. The system controller counts the number of samples processed and advances the hopper feeder to unload another sample set for the next test sequence.

Advantageously, in the present invention, a flexible automatic test station is provided which can increase overall productivity by allowing the system operator to perform other duties or tests that are not susceptible to robotic controlled performance while the test station is processing multiple sample sets. These duties also could include reviewing test data and loading additional sample sets into the station. Also, a station in accordance with the present invention can be operated in an unattended mode, and thus can conduct tests after regular work hours to accommodate peak work loads without requiring training of additional operators to conduct the tests manually. In addition, because the test station uses conventional instruments, those instruments can be manually used when the automatic feature of the test station is not being used. Another advantage to the flexible test station of the present invention is that it can be modified as needed by the addition or deletion of various measuring instruments (modified for remote microprocessor control). Yet another advantage is that if one instrument becomes inoperative, the test station may stop operation and alert an attending operator or, if unattended, skip the inoperative instrument and continue to perform the other tests on the samples in the sample sets.

BRIEF DESCRIPTION OF THE DRAWINGS

Further features of the invention, its nature and various advantages will be more apparent from the accompanying drawings and the following detailed description of the invention, in which like reference numerals refer to like elements, and in which:

FIG. 3 is a side view taken along line 3—3 of FIG. 2;

FIG. 4 is a top view taken along line 4—4 of FIG. 2;

FIG. 5 is a side sectional view taken along line 5—5 of FIG. 2;

FIG. 6 is a representative view of one embodiment of the field of view of the length measuring station;

FIG. 7 is a representative view of a second embodiment of the field of view of the length measuring station;

DETAILED DESCRIPTION OF THE INVENTION

Figure 1:
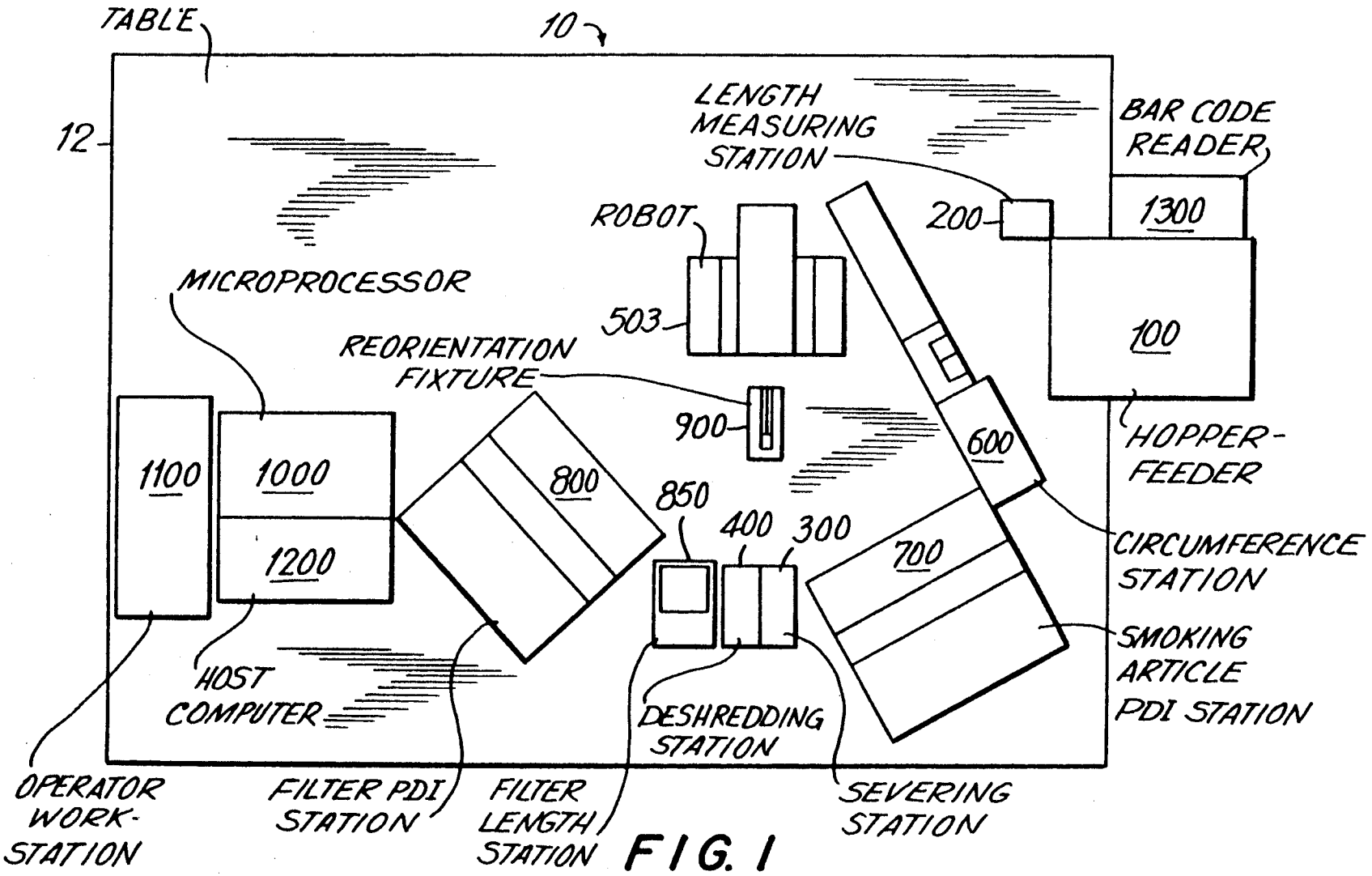
FIG. 1 is a schematic top plan view of the present invention.

Referring to FIG. 1, station 10 in accordance with a preferred embodiment of the invention includes table 12, robot 503, hopper-feeder 100, station 200 for measuring the length of an article, circumference station 600 for measuring the circumference of the smoking article, PDI station 700 for measuring the smoking article pressure drop and filter ventilation, fixture 900 for reorienting a smoking article, severing station 300 for severing an article component from the article, deshredding station 400 for removing tobacco shreds from the severed component, PDI 800 for measuring the filter pressure drop, station 850 for measuring the length of a filter, and microprocessor 1000 for controlling the operation of station 10. Associated with station 10 is host computer 1200 for containing test protocols and parameters in a database listing and acquiring test data for tabulation, evaluation and analysis. Additionally, station 10 includes operator workstation 1100 and barcode reader 1300.

Table 12 is preferably a flat table for supporting the various devices, instruments, and processing stations at positions within the reach of robot 503. Table 12 is sufficiently large, e.g., five feet by seven feet, to restrict an operator from interfering with the motion of robot 503 and either injuring the operator or halting the motion of the robot.

Referring to FIGS. 1-5, hopper feeder 100 has a plurality of pockets 110 attached to a continuous belt 120 that travels around sprockets 122. In one embodiment, belt 120 is indexed to advance the plurality of pockets 110 a distance corresponding to the spacing between each pocket. In the preferred embodiment, each pocket 110 is capable of containing a sample set of a plurality of smoking articles 20, for example, up to thirty articles, preferably of the same type or brand. Each pocket 110 will typically contain a sample set of a plurality of like articles 20 that may be the same or different from each sample sets in other pockets.

Figure 2:
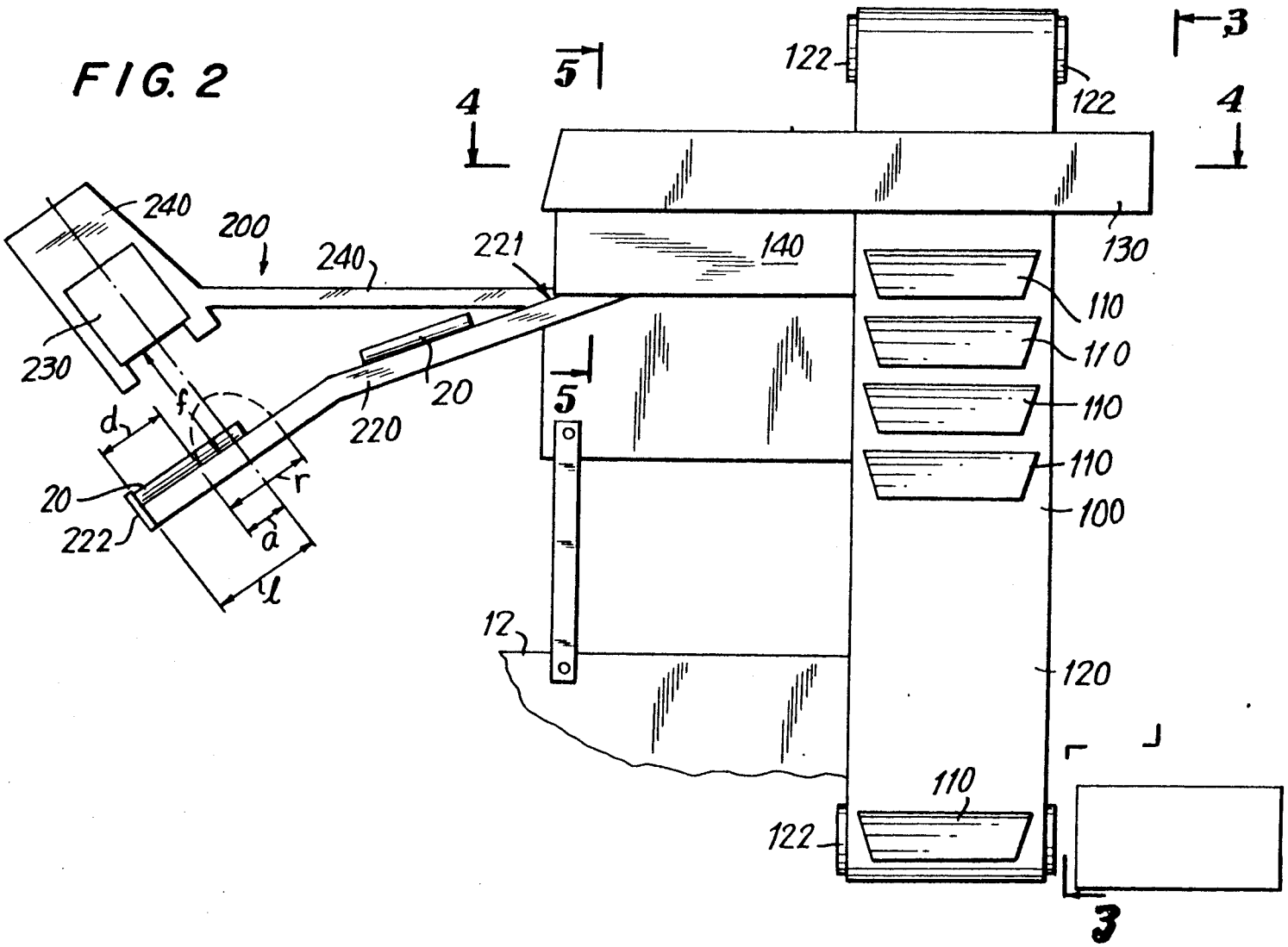
FIG. 2 is front view of the hopper feeder and length measuring station of FIG. 1.

An unloading device 130 is positioned at a selected location relative to the path of belt 120 so that as one of pockets 110 is indexed into alignment with device 130, the contents of the one pocket are transferred from that pocket into device 130. Unloading device 130 may be a paddle or flange that pushes the articles out of pocket 110 or alternatively manipulates pocket 110 to release its contents. Referring to FIG. 2, device 130 moves from an extreme left position to an extreme right position in a range of travel. One pocket 110 is indexed into alignment with device 130, which is then moved from its extreme right position to its extreme left position, thereby pushing articles 20 out of the one pocket 110 and into a feed mechanism 140.

Feed mechanism 140 dispenses the articles in device 130 one at a time into chute 220. One such feed mechanism 140 may be, for example, a V shaped feed structure 150 having an aperture 152 at the vertex so that articles 20 are fed through the vertex aperture one at a time, and a device for receiving one article at a time for transferring that article to chute 220 (not shown). Preferably, the plurality of articles 20 in pockets 110 are longitudinally aligned with chute 220 so that no angular manipulation is required.

Hopper feeder 100, unloading device 130, and feed mechanism 140 are preferably a commercial device, for example, model AHL 100, purchased from Fidus Instrument Corporation. The commercial device is constructed with a funnel type feed mechanism for feeding the contents that are unloaded from a pocket one at a time, in a vertical direction downwardly, to an interconnected commercial CTS or FTS test station. For adaptation for use with the present invention, the conventional funnel mechanism was removed and the commercial hopper feeder device was installed at one edge of table 12 proximate to chute 220 so that chute 220 receives at an angle each article 20 as it is fed out the feed mechanism provided with the commercial device. Thus, each article 20 slides down chute 220 at an angle to horizontal.

The commercial device also was modified by the addition of feet (not shown) so that it would stand on the floor. Hopper system 100 as purchased contained motor drive electronics and controls that connected directly to a computer. This required that the computer send a pulse to the stepping motor each time belt 120 was moved, requiring 16,000 pulses to index from one pocket 110 to the next. To offload computer 1000 from this task and so that computer 1000 may be used for other potential tasks, a commercial preset indexer was added (not shown). This device is programmed to generate the required number of pulses when computer 1000 toggles a digital input on the indexer. The indexer is capable of generating the control signals for device 130, thus offloading control computer 1000. The digital input on the present indexer can also be toggled using a pushbotton, allowing manual control of the system 100. This manual control may be used for set-up and adjustments to system 100 and for troubleshooting, all without use of computer 1000. The as purchased control of feed mechanism 140 likewise required computer control to monitor the index detector, to determine when to stop the motor driving device 140. Hopper system 100 was similarly modified to work independently, turning the feed mechanism one revolution and stopping automatically whenever a digital input is toggled to start the motor rotation.

Referring to FIGS. 1 and 13-21, robot 503 includes base 590, rotating platform 591, pivoting member 592, pivoting arm 593, hand 500, and opposing members 510 and 520. Base 590 provides base rotation in the horizontal plane of robot 503 about an axis and is secured to table 12. Pivoting member 592 provides for shoulder joint movement by rotating in a two dimensional vertical plane. Pivoting member 593 provides for elbow joint movement by rotation in a two dimensional vertical plane. Hand 500 provides a wrist pitch motion and wrist rotation motion in three dimensions. Hand 500 includes means for translating a pair of opposing members 510 and 520 for gripping one smoking article 20 toward and away from each other so that the opposing members contact and grip article 20 securely without deforming article 20.

Robot 503 preferably has five independently controlled axes with position repeatability of +/−0.5 mm, and a maximum reach in the range of from about 24 to 27 inches. Robot 503 is controlled by microprocessor 1000 and is thus capable of operating unattended and repeatedly performing each of the possible sequences or processes with the same accuracy and precision. Because it is a software controlled device, robot 503 can be controlled by appropriate programming to perform a sequence of motions which may be the same or different for each article that is gripped and maneuvered as described below.

Robot 503 is preferably a model Movemaster II, manufactured by Mitsubishi, Inc., of Japan, and available from Perkin-Elmer Corporation as part of a product known as the MasterLab TM System. The MasterLab TM device includes as microprocessor 1000 an IBM PC computer, model AT, having an Intel 8088 microprocessor device, 286 kilobyte memory, and software appropriate to control the initialization and motion of robot 503 relative to base 590 in the five dimensions and, thus, relative to each of the stations with which robot 503 interacts as described herein. The software for controlling the motion of the robot uses the commercial known programming language PERL (Perkin-Elmer Robot Language), which is a menu driven language having a dedicated command structure. Microprocessor 1000 also is provided with appropriate and conventional data communication ports to control the various test instruments to perform the desired measurements when the smoking article or the filter portion or other component is inserted into the measuring station, and to receive test data obtained. Appended hereto as a software appendix is a software listing for operation of robot 503 of automatic test station 10 in accordance with the present invention.

Referring to FIGS. 13–20, a preferred embodiment of the opposing gripping members of robot 503, in accordance with the present invention, are shown. First member 510 is secured to flange 501 and support member 560 (and hence member 520) is secured to correspondinq flange 502 so that members 510 and 520 are generally disposed in relatively fixed angular orientations, e.g., in parallel, and have opposing respective inner surfaces 511 and 521. Force altering means 570 is connected to support member 560 and second member 520. It provides for moving member 520 relative to support 560 to alter or adjust the force exerted on gripped smoking article 20, thereby to maintain the force below the force that would otherwise be imposed on smoking article 20 if there was no such movement, and below a selected maximum force that might crush or deform article 20.

In the preferred embodiment, force altering means 570 includes lever 530, spring 540, stop 550, and pin 563. Lever 530 is secured at one end to member 520 by bolt 531. Spring 540 is set within receptacle 541 milled in support 560 and urged against lever 530. Member 520 is pivotally secured to support 560 between yokes 561 and 562 about pin 563. Stop 550 is adjustable secured to support 560 so that it extends a selected distance from support 560. Stop 550 includes a flange 551 that is configured to fit over end 533 of lever 530. Spring 540 thus urges lever 530 against stop 550 flange 551. The range of motion of lever 530, and hence member 520, is limited by the motion of lever end 533 between support 560 and stop 550 as lever 530 pivots about pin 563. The position of stop 550 is adjustable to control the range of motion and is typically set so that member 520 is normally biased parallel to member 510 when not in contact with any article 20. Stop 550 also is used to keep member 520 from over-extending towards member 510 due to the force that spring 540 exerts on lever 530.

In an alternate embodiment, stop 550 could be adjusted so that tip 522 is biased closer to tip 512 than yokes 561 and 562 are spaced to member 510. This provides for gripping a slightly greater range of differently dimensioned articles as compared to when members 510 and 520 are biased parallel, but makes positioning members 510 and 520 about each article more difficult, requiring a comparatively larger distance between members 510 and 520 in the open position. Similarly, member 570 could be adjusted so that some of the force that would otherwise be exerted by members 510 and 520 on article 20 is altered when each article in this preselected range of differently dimensioned articles is gripped.

Member 520 has a notch 525 cut in surface 521 near tip 522 and member 510 has a corresponding notch 515 cut in opposing surface 511 near its tip 512. Notches 515 and 525 are thus in opposition for gripping a smoking article 20 therebetween. Notches 515 and 525 each preferably comprises two planar surfaces that intersect at an angle $\alpha$ of approximately 90 degrees. Further, the notches are arranged to form a receptacle for receiving and supporting article 20.

The shape and dimension of notches 515 and 525 are chosen so that a preselected range of dimensions of differently dimensioned smoking articles 20 can be supported and securely gripped by opposing forces exerted by members 510 and 520. Differently dimensioned articles thus may have different contact points on the respective planar surfaces. Furthermore, notches 515 and 525 are configured so that each smoking article is held rigidly in place along four contact points between members 510 and 520 and does not "slip" axially or longitudinally while it is being maneuvered from station to station or held in place at a station. Other angles and contoured shapes for notches 515 and 525 may be used.

In a preferred embodiment, the gripping surfaces of notches 515 and 525 are lined with conventional emery paper, for example, 240 grade, or some other mildly abrasive material to increase the friction between smoking article 20 and members 510 and 520 and to minimize slip.

In operation, upon an appropriate instruction from microprocessor 1000, flanges 501 and 502 are translated to an "open" position spaced apart a first distance and hand 500 is maneuvered to position notches 515 and 525 on opposite sides of and in alignment with a selected smoking article 20. Article 20 may be resting on chute 220, reorientation fixture 900, or on any one of the measuring instruments having a suitable receptacle. The first distance is large enough to straddle the largest circumference smoking article in the preselected range of circumferences.

Next, microprocessor 1000 instructs robot 503 to "close" flanges 501 and 502 so that member 510 and support member 560 are translated together and spaced a second distance apart and notches 515 and 525 are in gripping contact with the smoking article. Preferably, member 510 and support 560 are maintained in a parallel orientation. The second distance and the dimensions and depth of notches 515 and 525 are selected so that in the closed position, notches 515 and 525 will grip securely without deformation the smallest and largest dimensioned smoking articles in the preselected range of articles.

In accordance with the preferred embodiment, spring 540 biases lever 530 against stop 550 so that member 520 is urged parallel to member 510. Thus, for the smallest dimensioned article in a selected range, members 510 and 520 are configured and spaced to grip securely the article in notches 515 and 525 whereby member 520 does not significantly move relative to support 560. For larger dimensioned articles in the selected range, the larger dimension will move member 520 to pivot away from member 510 and compress spring 540. Spring 540 will continue to bias member 520 toward member 510 to grip securely article 20, even though the second distance is such that the larger dimensioned article would have been crushed in notches 515 and 525 had member 520 not pivoted relative to support 560. In this manner, spring 540 alters or adjusts the force exerted on article 20 so that article 20 is not crushed.

Advantageously, force altering means 570, and in the preferred embodiment spring 540, permits members 510 and 520 to grip securely a wider variation of smoking article dimensions, specifically circumferences, than would be possible by members 510 and 520 that did not have a force altering means. These improvements in gripping range and performance are important for use in a robotic automated test station where different dimensions present substantial problems, in contrast to a manually conducted system where the operator can intuitively adjust his or her grip to the dimension of the article. In this regard, a plurality of smoking articles to be tested do not inherently have identical physical characteristics. For example, there may be a variation in smoking article circumference from article to article in the same sample set or from one group of article to another. In addition, multiple sample sets may have differently dimensioned like articles. A gripping mechanism for a robotic device in accordance with the present invention is thus able to accommodate the desired variations in dimensions so that the resulting testing data of multiple sets is automatic, reliable, and reproducible without an attendant or need to adjust or change the opposing gripping members.

A pair of gripping members 510 and 520 has been constructed and operated successfully for grasping smoking articles having a circumference dimension selected in the range of from 22 to 25 mm. Referring to FIGS. 15–18, members 510 and 520 were constructed with mirror image tip portions each having a width d of about 0.56 inches and a thickness t of about 0.28 inches. Notches 515 and 525 each has two planar sides cut at 45° angles to the surface, thereby forming an angle α of 90°, the vertex of which extends a depth h of about 0.172 inches relative to member surfaces 511 and 512. The notch base of depth h is located a distance r of about 0.280 inches from the tip of the member, and the opening of the notch has a space s of about 0.345 inches. The distance between surfaces 511 and 521 was fixed at about 2.0 mm, which was obtained by manually filing down a shim plate (not shown) to bring faces 511 and 521 sufficiently close together to obtain a good secure grip on the smallest dimensioned article to be processed, e.g. 22 mm in circumference, without deflecting members 510 and 520.

Member 520 is configured so that the base of notch 525 is spaced about 1.22 inches from the axis of pin 563. The spring force of spring 540 is selected to be a few ounces, preferably three to six ounces. Of course, the optimum spring force for a given gripper design will be selected based upon the particular geometric distances employed in the design of lever 530, member 520, notches 525 and 515, the spacing between member 510 and 520, the range of motion of the hinge of member 520, and the selected range of differently dimensioned smoking articles to be tested. The magnitude of the spring force will depend in part on the distance of separation between pivot pin 563 and notches 525 and 515 and the distance of separation between pivot pin 563 and spring 540.

In accordance with the invention, other types of opposing gripper members may be used, for example, a member which translates, as opposed to rotates, relative to a support, in combination with a force altering means which allows the member to move relative to the support. Furthermore, the force altering means can have non-linear characteristics in contrast to the typically linear characteristics of a conventional spring.

Advantageously, robot 503, in accordance with the present invention, provides for an economical and efficient gripping of a variety of conventionally sized smoking articles having a circumference in a preselected range of circumference dimensions, including cigarettes, for efficient manipulation of such articles through a programmed sequence of movements and operations without having to change or adjust manually the robotic gripping elements for differently dimensioned articles in the range.

Referring to FIGS. 1, 2, and 5, one embodiment of length station 200 for measuring the length of an article in accordance with the present invention includes chute 220, camera 230 and bracket 240. Chute 220 is configured to receive one article 20 at top 221 of chute 220, and is provided with a grooved surface having a U-shaped cross sectional shape (see FIG. 5) so that article 20 will advance along chute to stop 222 under gravity. Such a surface also may be concave or V-shaped and may be coated with a low friction material, e.g., Teflon TM, or highly polished to minimize friction between article 20 and chute 220. Chute 220 also may comprise two rods or rails that are spaced-apart in parallel (not shown) so that articles 20 will proceed along chute 220 and any tobacco or other particles that come loose from articles 20 do not accumulate in chute 220 or otherwise impede the advance of articles 20.

Camera 230 is mounted on bracket 240 to be positioned a selected distance from chute 220. Camera 230 is preferably an electronic linear array camera for measuring lengths along one axis or dimension. Accordingly, that measuring axis is oriented in parallel with chute 220 so that article 20 will be in the proper orientation for obtaining the length measure. Camera 230 is located a focal distance f from the location article 20 will be at when it is measured, and is provided with a field of view r corresponding to focal distance f.

The measurement may be obtained directly by measuring article length L within the field of view r (see FIG. 6) or more preferably indirectly, by measuring the length a of article 20 that extends into the field of view from one edge of the field of view in the first axis (see FIG. 7). In the indirect mode, one edge of field of view r is located a known distance d from stop 222. Thus, camera 230 obtains the measure l of article 20 indirectly by summing the measured length a and the known distance d.

In accordance with a preferred embodiment, camera 230 is configured so that distance d is 75 mm, field of view r is 50 mm, one end of which is spaced 75 mm from stop 222, the other end of which extends to 125 mm from stop 222, providing for a focal distance f selectable in the range of from 225 to 260 mm. Thus, camera 230 is capable of measuring automatically conventional cigarettes having a length from 75 to 125 mm. In embodiments where the image appearing in field of view r of camera 230 is not a true measure, the measure must be converted by the magnification (or reduction) power of the camera lens to obtain the true length dimension.

In an alternate embodiment, stop 222 may be provided with a contact switch (not shown) that produces directly or through microprocessor 1000 an enabling signal to camera 230 when article 20 comes to rest against stop 222. In this embodiment, camera 230 will obtain the length measurement in response to the enabling signal.

Camera 230 is preferably a model HVS 256 camera sold by the Microswitch Division of Honeywell, Engelwood, Colo. and has a resolution of 256 pixels in a selected linear dimension or axis. Model HVS 256 is preferably configured to obtain a 50 mm field of view at an accuracy of better than 0.1 mm, preferably 0.05 mm, corresponding to a resolution of better than 0.1 mm, preferably 0.02 mm. It is a relatively inexpensive linear array camera, and is thus advantageous to use to measure indirectly the article length.

In making indirect measurements, the first distance d the field of view r and the desired resolution may be adjusted to measure a desired range of acceptable lengths (and variations in lengths) of a large number of different smoking articles.

Also, camera 230 may be moved outwardly and refocused or a different lens used to have a correspondingly increased field of view, or the distance d may be changed as may be appropriate. Other linear array cameras having more pixels, e.g., an EG&G Reticon camera, model LC0120, having 4096 pixels and a resolution of 0.01 mm in one axis, or fewer pixels with a corresponding lower resolution could be used to obtain directly or indirectly the length measurement. Typically linear array cameras having such a higher pixel resolution are, however, substantially more expensive.

Electronic linear array cameras provide almost an instantaneous measure of indirect length a or direct length l depending on the desired configuration. Accordingly, continuous motion length measures are possible. Measures taken while the article is stationary for a period of 0.085 seconds are, however, preferred for optimum resolution.

Camera 230 is preferably adapted to transmit electronically the measured length to microprocessor 1000, which may in turn transmit the data to host computer 1200 for recording and tabulating the data for each article 20 measured.

Subsequent to the length measurement, robot 503 grips article 20 between members 510 and 520 at a distance that is about 65 mm from the filter end for maneuvering article 20 off chute 220 to the selected one or more workstations for subsequent measurements or tests of the characteristics of the smoking article. Accordingly, chute 220 and stop 222 are suitably located within the range of motion of robot 503 with adequate clearance relating to robot hand 500.

Figure 22:
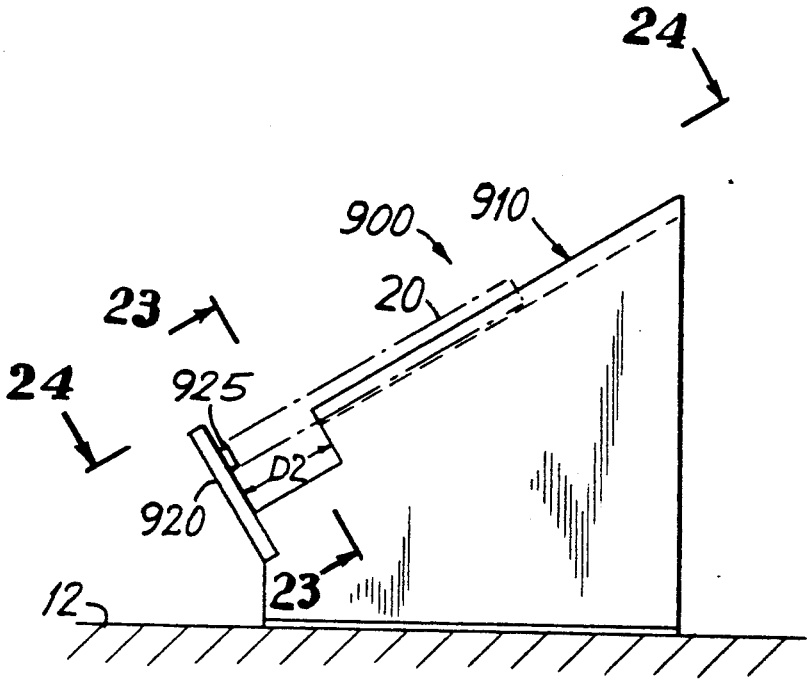
FIG. 22 is an side view of the reorientation fixture of FIG. 1.
Figure 23:
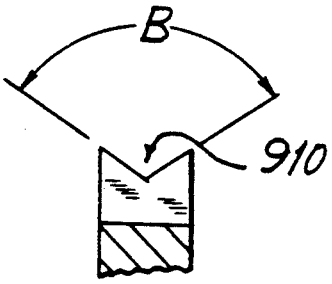
FIG. 23 is an end view taken along line 23—23 of FIG. 22.
Figure 24:
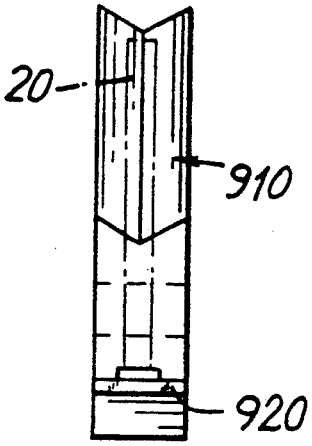
FIG. 24 is top view taken along line 24—24 of FIG. 22.

Referring to FIGS. 22–24, fixture 900 for reorienting a smoking article is located on table 12 at a position within reach of robot 503. Fixture 900 provides a location into which an article 20 (shown in phantom lines in FIG. 22) can be deposited by robot 503 so that robot 503 can change its grip article 20 to a different location. Fixture 900 includes a v shaped, concave surface 910 having a length and two planar surfaces intersecting at an angle B of 110 degrees. Surface 910 is spaced from a stop 920 a distance D2 of about 1.25 inches to allow members 510 and 520 of robot 503 to grip article 20 without contacting fixture 900. Stop 920 is preferably oriented perpendicular to surface 910 and includes a protrusion 925 which extends from stop 920 so that the end of article 20 is spaced a short distance from stop 920. Surface 910 is preferably at an angle of about 30 degrees relative to table 12 (horizontal) so that article 20 will slide down surface 910 and rest against protrusion 925 of stop 920.

Figure 8:
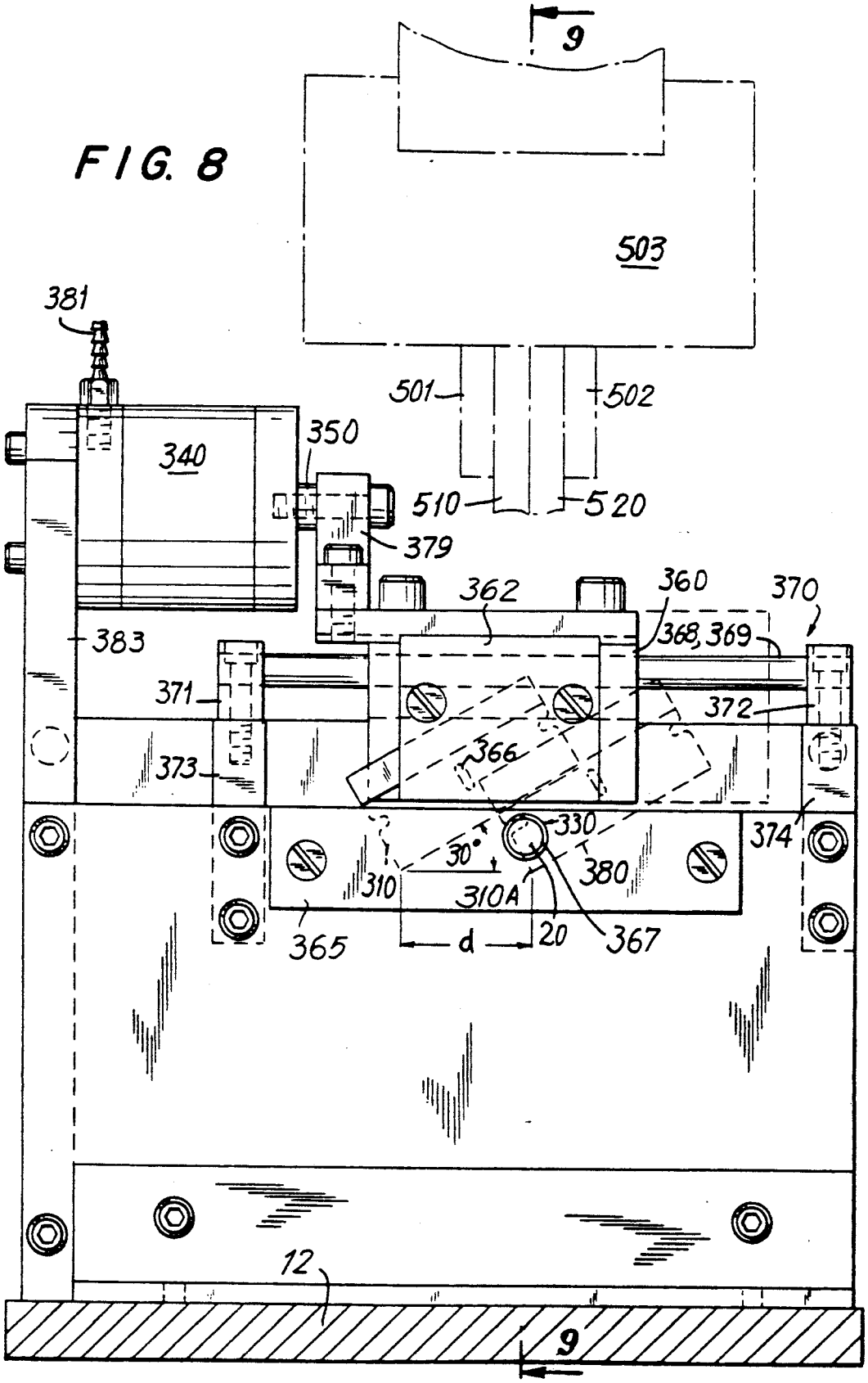
FIG. 8 is a front sectional view of severing station 300 of FIG. 1.
Figure 9:
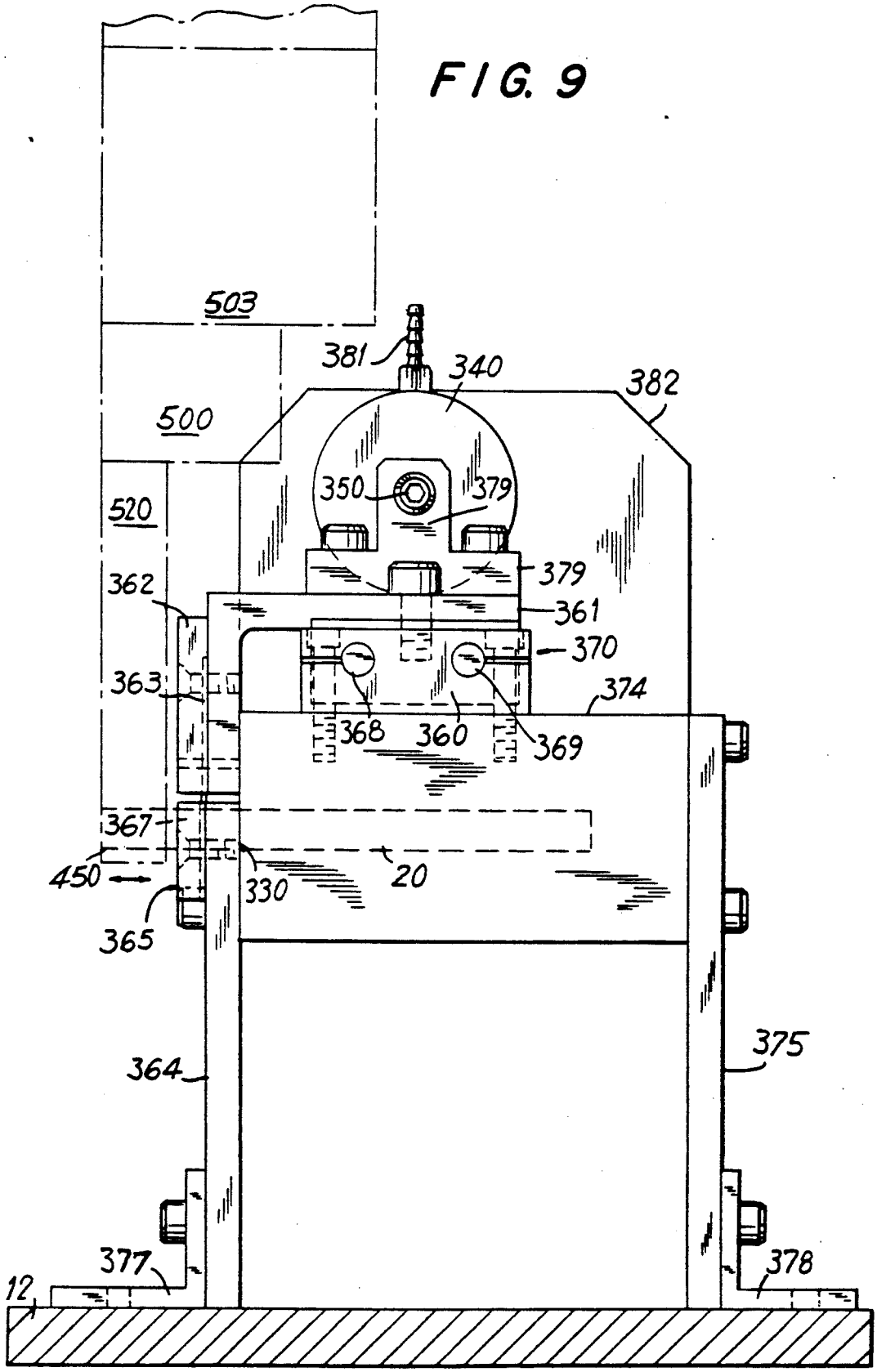
FIG. 9 is a side view taken along line 9—9 of FIG. 8.
Figure 10:
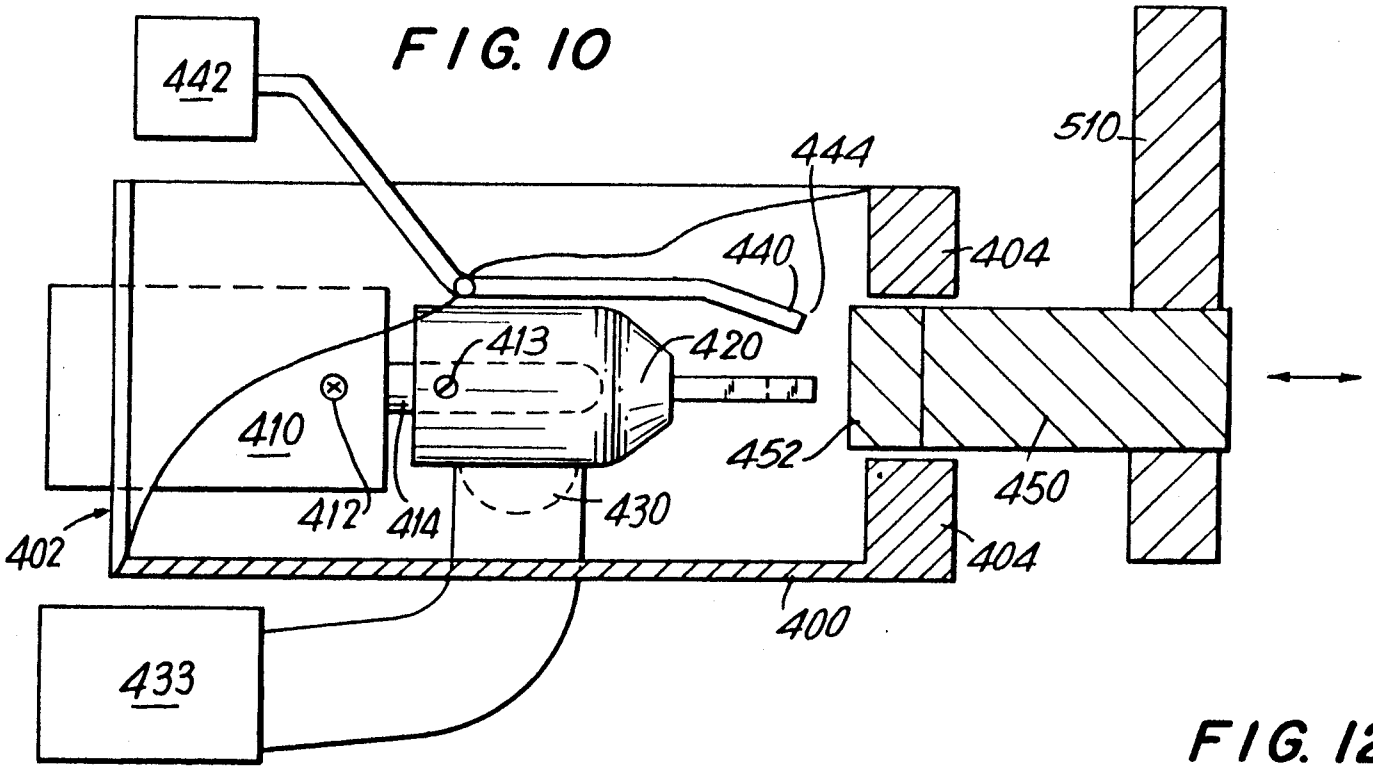
FIG. 10 is a partial sectional view of the deshredding station of FIG. 1.

Referring to FIGS. 1, 8, and 9, severing station 300 for severing an article component from the article, more particularly filter rod portion 450 of the article, includes a cutting element 310, aperture 330, air cylinder 340, and ball slide unit 370. Cutting element 310 is used to pass through to sever one smoking article 20 after it is positioned at a selected location in aperture 330 by members 510 and 520 of robot 503. Cutting element 310 is mounted on carriage 360 of ball slide unit 370 between opposing carriage bracket 361 and clamp plate 362. Carriage 360 is mounted on two slide bars 368 and 369, which are mounted in two end blocks 371 and 372 that are respectively supported by spanner bars 373 and 374. Spanner bars 373 and 374 are in turn supported by front side plate 364 and rear side plate 375. Ball slide unit 370 provides a straight, one-dimensional cutting path along which element 310 will travel and may be, for example, model no. DS3-2-C, manufactured by Stelron. The stroke length of air cylinder 340 thus defines the maximum stroke length for element 310, for example, 2.54 cm.

Movement of element 310 is controlled by air cylinder 340 which actuates piston rod 350 to move carriage 360 and carriage bracket 361 in a lateral direction along slide bars 368 and 369. Piston rod 350 is attached to carriage bracket 361 by cylinder block 379. Piston rod 350 is connected to air cylinder 340 and is moved back and forth by air cylinder 340. Air cylinder 340 is preferably a single action device in that a force is applied to extend piston 350 and a spring (not shown) returns piston 350 to its rest position following a lowering of the force. For example, a pressure of 40 psi of compressed air, applied to compressed air inlet 381 of air cylinder 340, may be used to extend piston 350 to drive carriage 360 so that cutting element 310 passes through smoking article 20. Air cylinder 340 is preferably part no. FOS-04-1.000-3 (Flat 1 air cylinder-single acting-spring return-¾ inch bore-1 inch stroke) manufactured and available from Bimba. Air inlet 381 of the cylinder is preferably model no. 11752-1 (hose fitting-#10-32 to ⅛ inch I.D. hose) manufactured by Clippard.

Air cylinder 340 is supported by end plate 383 which is also used to separate front side plate 364 from rear side plate 375 and to give overall stability to the cutting unit. Further stability to the cutting unit is provided by support angles 377 and 378 attached to front side plate 364 and rear side plate 375 and table 12.

In one embodiment of the present invention, a solenoid (not shown in the Figures) is used to control delivery of compressed air to inlet 381 to initiate the cutting process. The solenoid is preferably actuated by microprocessor 1000 in response to article 20 being placed in the selected second location. The solenoid also can be controlled manually by a switch mounted in the vicinity of the cutting apparatus.

Alternate devices for moving cutting element 310 in response to article 20 being placed in the second position include stepper motors, linear actuators, rack and pinion mechanisms and similar devices.

Cutting element 310 is preferably a sharp blade, more preferably a conventional single-edged razor blade having a blade length of 3.88 cm. Blade 310 is mounted to carriage 360 between opposing carriage bracket 361 and clamp plate 362. The razor-blade side of clamp plate 362 includes recess 363 which is configured to hold razor blade 310 in the recess at a fixed angle relative to the piston direction. The angle must be sufficient so that the blade severs the smoking article (as contrasted to crushing the article) and passes completely through the cross section of article 20, e.g., 25 to 35 degrees used, more preferably 30 degrees. Additionally, roll pin 366 maybe used to keep razor blade 310 in place during the cutting motion.

In accordance with a preferred use of the present invention, prior to the severing operation, article 20 is preferably placed in orientation station 900 by robot 503. This permits robot 503 to grip article 20 at the mouth end of filter portion 450 between opposing members 510 and 520 and maneuver article 20 axially into aperture 330 extending through front side plate 364 and blade guard 365 to a selected distance or depth. The diameter of aperture 330 is preferably larger than the circumference of the article to be cut to provide tolerance for inserting and extracting articles 20 having a range of circumferences. In a preferred embodiment, the diameter of aperture 330 is 0.328 inches (8.33 mm) for cigarettes having a circumference in the range of 22–25 mm. Aperture 330 can be modified to accommodate smoking articles of other diameters or cross-sectional shapes by replacing front side plate 364 and blade guard 365 with a front side plate and blade guard having an aperture of appropriate dimensions. Preferably, aperture 330 also includes countersink 367 in blade guard 365 to assist in the initial guiding of article 330 into the cutting position.

During the cutting operation, robot 503 holds article 20 by its filter end portion 450 with the portion of the article to be severed in the cutting path of blade 310. Once in the second location, air cylinder 340 is actuated to move razor blade 310 to sever article 20 at the designated portion.

Microprocessor 1000 positions robot 503 in response to the previously identified length of the article segment to be severed, e.g., filter portion 450 of a cigarette. Thus, robot 503 is programmed to move members 510 and 520 to grip article 320 at, for example, at the mouth end or at midpoint of the filter segment 450, and to insert article 320 to a depth so that razor blade 310 will sever article 320 at a location that is a selected distance from the end of the filter segment to be severed. The selected distance is preferably 2 mm. For example, for a smoking article having a nominal filter length of 27 mm, the robot may be programmed to cut the smoking article at a distance of 29 mm from the mouth end of the filter. Thus, the razor blade will cut through the tobacco and not the filter material.

Advantageously, in accordance with the present invention, severing station 300 provides for severing a filter rod portion from a smoking article so that the automatic test station can perform characterization tests both on the complete article and its filter (or other) component. The precision and accuracy of the cutting operation is determined by the precision and accuracy of the mechanical parts of the computer controlled apparatus as contrasted to an operator's manual ability. The quality of the cut also has been made more reproducible, thereby enhancing statistical analysis and accuracy of tests performed on a plurality of like components severed from a plurality of like smoking articles.

Referring to FIGS. 1, and 10–12, deshredding station 400 for removing tobacco shreds from the severed component includes housing 400, deshredder motor 410, deshredder tool 420, vacuum port 430, and air stream conduit 440. Housing 400 has a motor end 402 and an aperture end 404. Deshredder motor 410, which is mounted in end 402 of housing 400, is used to rotate deshredder tool 420 at a selected speed in the range of 3000 to 4000 rpm, preferably 3600 rpm. Robot 503 inserts filter portion 450 (shown in cross section) in end 404 of housing 400 in axial alignment with motor 410 and tool 420. End 404 has an aperture for receiving filter portion 450. The aperture dimension is preferably selected to receive smoking article filter portions having a circumference in a range of circumferences, e.g., 22–25 mm, and to permit annular air flow into housing 400 when filter portion 450 is inserted. Preferred aperture dimensions are 9 to 10 mm in diameter.

Presenting end 452 of portion 450 is preferably brought within a preselected distance, e.g., 2 mm, of the tip of deshredder tool 420. A stream of high pressure air from source 442 is blown onto presenting end 452 of filter 450 through conduit 440. Rotating deshredder tool 420 may contact the tobacco shreds attached to filter 450 that are not loosened by the stream of air, to loosen those shreds not removed by the air stream. Preferably, vacuum port 430 also is provided to exhaust out through a flow path to vacuum 433 any loosened tobacco shreds that have become detached from the end of the filter by the air stream, deshredder tool 420 or both.

Deshredder motor 410 is held in housing 400 by way of screws 412. Attached to the end of the deshredder motor shaft 414 is deshredder tool 420, which is held in place by way of set screw 413. Deshredder tool 420 can be made of a hard material, but most preferably it is made out of a hard steel or aluminum alloy, for example, having a black oxide finish.

Figure 12:
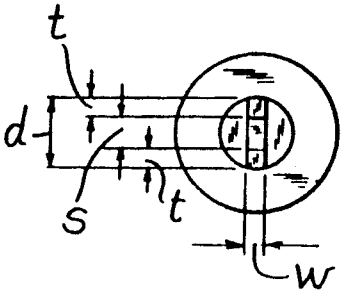
FIG. 12 is an end view taken along line 12—12 of FIG. 11.
Figure 11:
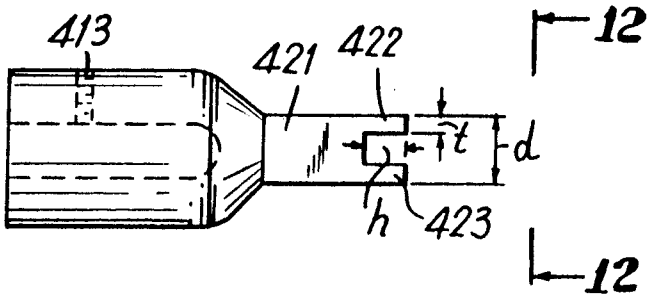
FIG. 11 is a side view of the deshredder tool of FIG. 1.
Figure 14:
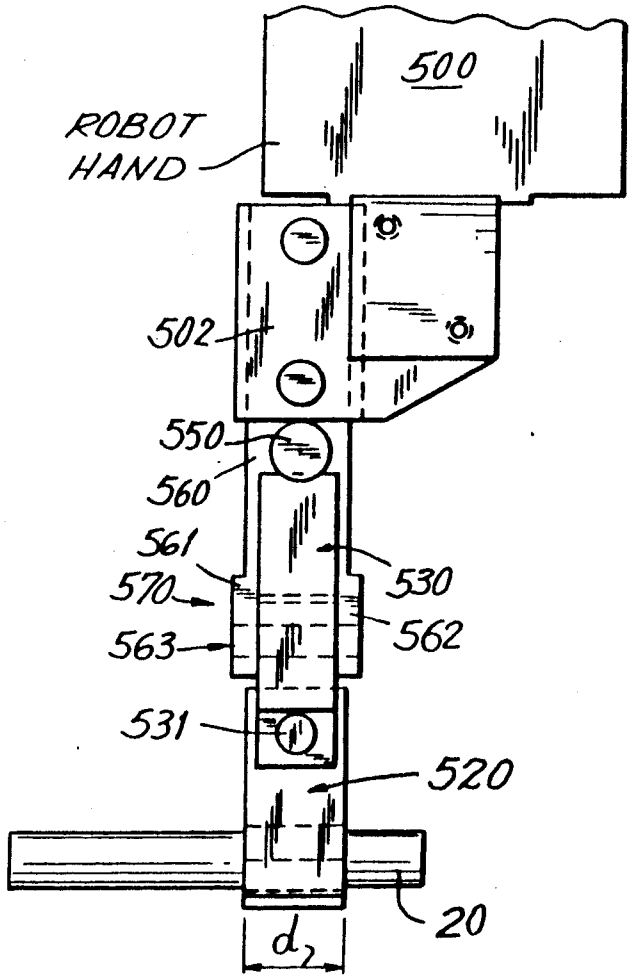
FIG. 14 is a side view taken along line 14—14 of FIG. 13.
Figure 13:
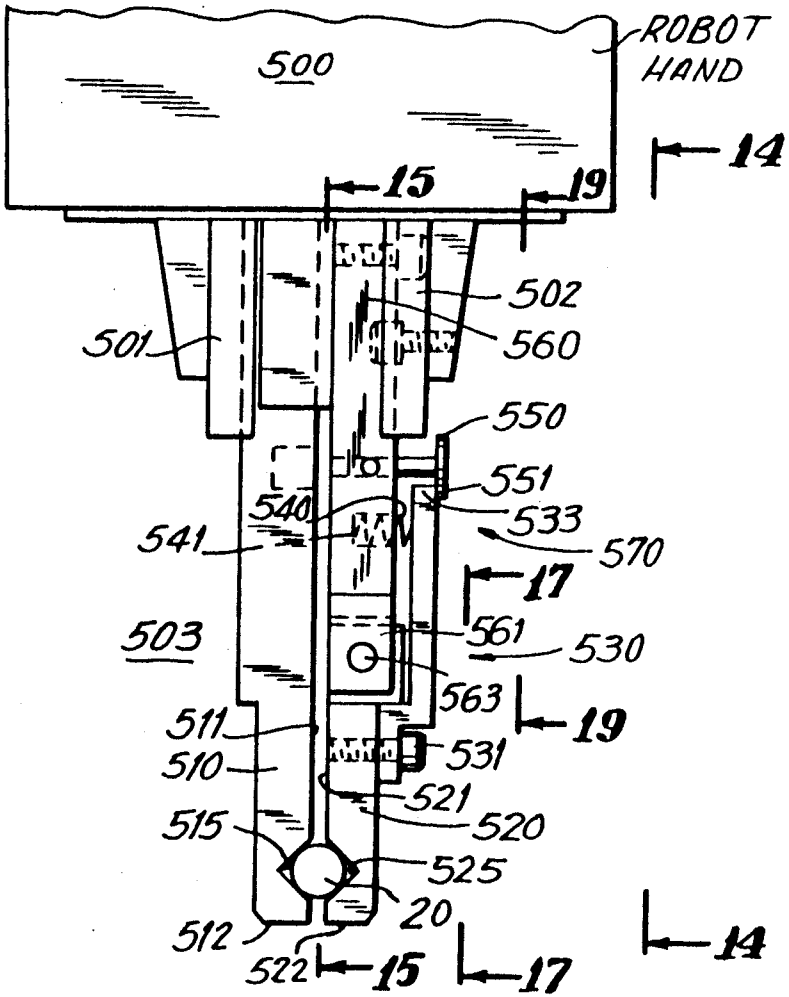
FIG. 13 is a front plan view of the gripping mechanism of FIG. 21.
Figure 15:
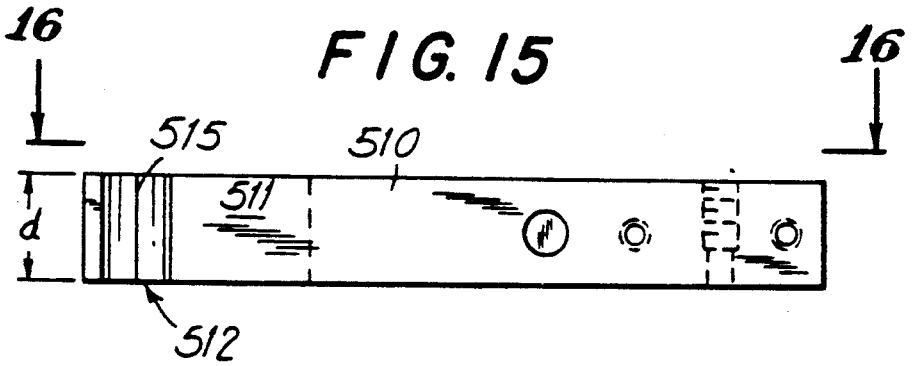
FIG. 15 is a side view taken along line 15—15 of FIG. 13.
Figure 16:
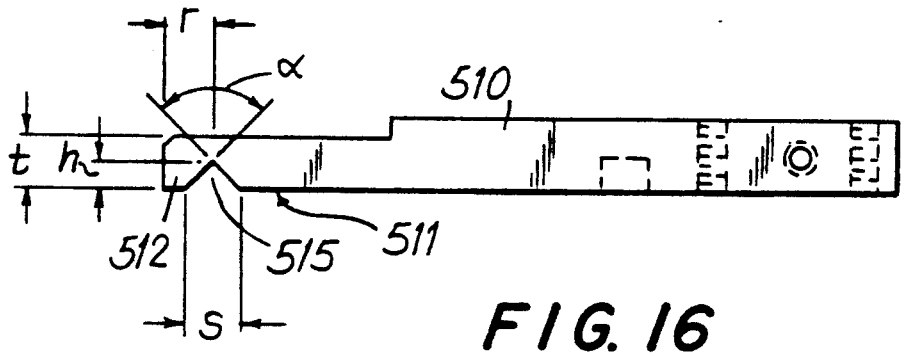
FIG. 16 is a front view taken along line 16—16 of FIG. 15.
Figure 17:
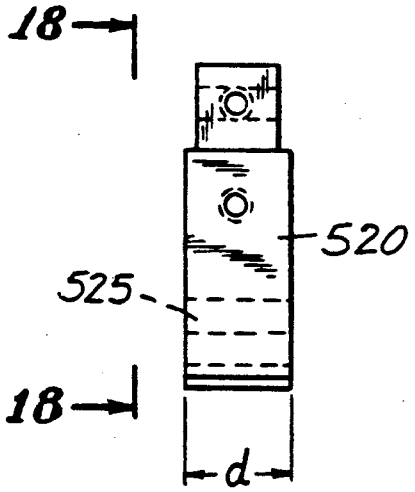
FIG. 17 is a side view of a grasping member taken along line 17—17 of FIG. 13.
Figure 18:
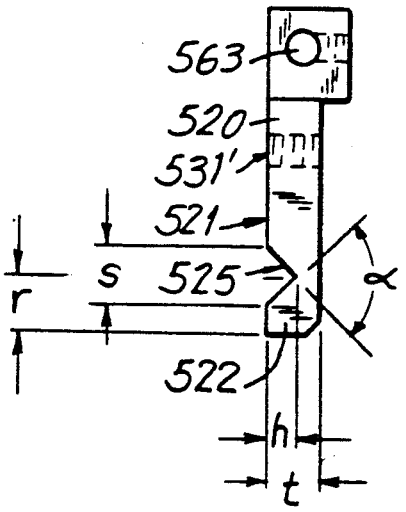
FIG. 18 is a front view taken along line 18—18 of FIG. 17.
Figure 19:
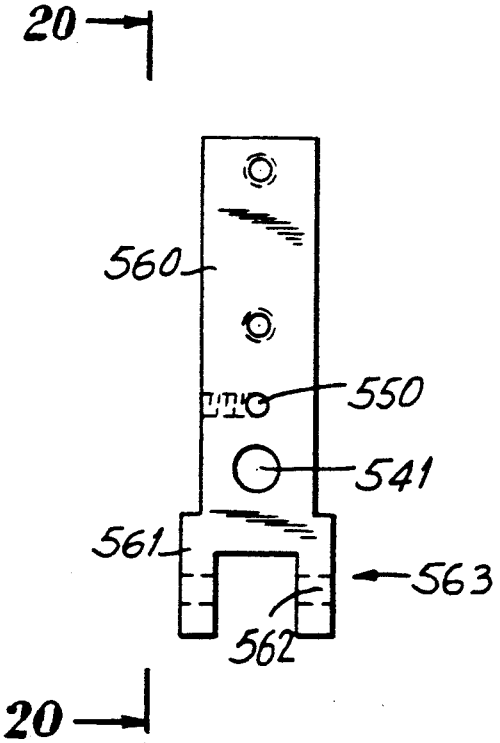
FIG. 19 is a partial sectional view taken along line 19—19 of FIG. 13.
Figure 20:
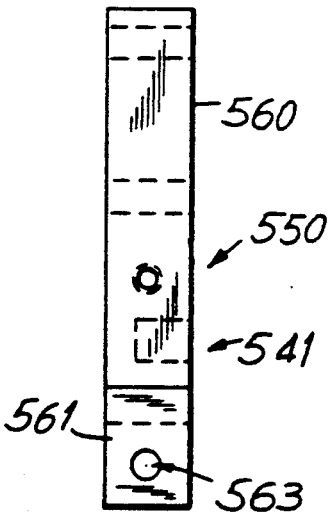
FIG. 20 is a front view taken along line 20—20 of FIG. 19.
Figure 21:
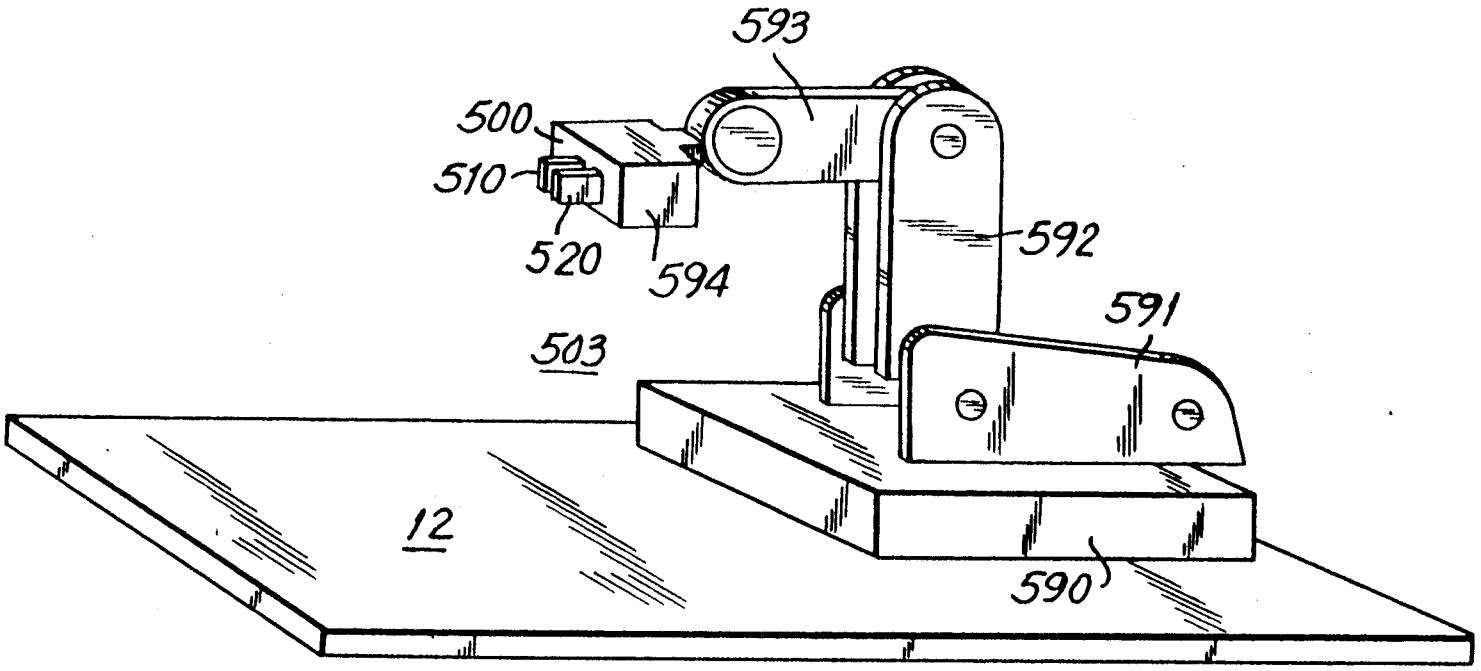
FIG. 21 is an elevated perspective view of the robot of FIG. 1.

Referring to FIGS. 11 and 12, tool 420 preferably has two prongs 422 and 423 extending from tip 421 such that tip 421 has a rectangular cross section of width w and length d. Length d corresponds to the diameter in which tip 421 rotates (which is less than the corresponding diameter of the filter portion), for example, in the range of 0.2 to 0.23 inches, preferably 0.2 inches. Each prong 424 and 423 preferably is a four sided structure of first dimension w, preferably about 0.45 inches, and second dimension t, preferably about 0.053 inches, such that each prong projects a distance h, preferably about 0.15 inches, from the unmilled rectangular body of tip 421 of tool 420. Prongs 422 and 423 are preferably located at the periphery of distance d, separated by space s of about 0.095 inches.

In accordance with an alternate embodiment, deshredder tool 420 may have an alternate motion, for example, a circular back-and-forth motion where the tool rotates half of a revolution before it reverses direction. Tool 420 also may have an alternate tip configuration, for example, more than two prongs, prongs at angles relative to one another, a hook, a scythe, a flat loop, or a spiral or helical section.

Conduit 440, which is preferably simply formed of standard ⅛ inch outer diameter copper tubing having an inner diameter of 0.07 inch terminates adjacent deshredder tool 420. Such tubing is malleable and conduit 440 can be bent, as necessary, to place tip 444 in close proximity to the selected location and deshredder tool 420, directed at presenting end 452 of filter 450. Tip 444 is preferably formed by cutting tube 440 transversely, but may also be provided with a configured shape to provide a nozzle. Source 442 is connected to conduit 440 and provides an air stream, preferably a high pressure air stream in the range of 10 to 40 psi, more preferably 20 psi. Source 442 preferably has an on condition and an off condition for regulating air flow depending upon whether or not a filter portion is in position or being brought into position to be deshredded. In accordance with the invention, other types of inert high-pressure gas, for example, nitrogen, and other types of gas jet delivery systems could be used.

Vacuum source 433 is attached to vacuum port 430 of housing 400 by conduit 432. Vacuum source 433 is preferably a ½ inch diameter house vacuum and has a suction in the range of 15 to 25 in.-Hg, sufficient to exhaust all of the gas provided through conduit 400 and maintain a nominal or slight negative pressure inside housing 400. Vacuum source 433 serves to entrain and to exhaust tobacco shreds which become detached from filter 450 and has an on condition and an off condition depending upon whether or not a filter portion is in position or being brought into position to be deshredded.

In operation, severed filter portion 450 is gripped between opposing members 510 and 520 of robot 503 at a first location, preferably the same position used for the severing operation, and is maneuvered axially into end 404 of housing 400. Robot 503 is provided with information specifying the length of the filter and positions filter 450 to a predetermined selected location corresponding to placing presenting tobacco end 452 of the filter 450 into the deshredding area. In one embodiment, microprocessor 1000 issues an instruction to activate each of deshredder motor 410 to cause tool 420 to rotate, air source 442 to commence air flow through conduit 440, and vacuum source 443 to commence exhausting air through port 430 during or prior to insertion. Thus, these elements are fully operative when filter 450 is positioned in the selected location. As robot 503 brings the end of filter 450 to within a few mm of deshredder tool 420, for example, 1.5 to 2.5 mm, more preferably 2 mm, presenting end 452 becomes subjected to the gas flow which will begin to loosen and remove tobacco shreds even before end 452 is at the selected location.

Robot 503 then holds filter 450 in the selected position for a period of 1 to 4 seconds, more preferably 2 seconds. At the end of this period, microprocessor 1000 issues instructions to deactivate deshredder motor 410, air source 442, and vacuum 433, and to remove the deshredded filter 450 from the deshredder housing 400. In an alternate embodiment, tool 420, source 442 and vacuum 433 may be continuously operating.

Depending on the amount of tobacco shreds to be removed, in the selected location tool 420 may be initially immersed in a relatively thick plug of tobacco shreds thereby to loosen the shreds, or may not be in contact with any shreds. The distance between the tip of tool 420 and the end of filter 450 is selected so that if the tool does not contact any shreds in area 452, the air flow has either removed them or is sufficient to remove them during the time period the filter is maintained at the selected location, and there is an insufficient force to retain the shreds on the filter end to withstand both the air flow and tool 420. In operation, it has been found that the air stream removes most of the tobacco and that the tool is most useful when the presenting portion contains a length of cigarette paper enclosing a plug of tobacco shreds in excess of 2 mm thick. Thus, using deshredding tool 420 to remove all but the last 2 mm of shreds provides for the air stream to remove the remaining shreds and complete the deshredding operation. In addition, deshredding tool 420 may provide a turbulent air stream that facilitates loosening the shreds.

In accordance with the present invention, a plurality of measuring instruments are provided as stations to perform characterization tests on one or more groups of like articles 20 or components, specifically filter portions 450, of articles 20.

Circumference station 600 measures the circumference of one article 20 at a time. Station 600 is mounted at a fixed position on table 12 within the reach of robot 503. Station 600 is preferably a commercial device, model Filtrona Lasermike FLM 200, available from Fidus Instrument Corporation, Richmond Va. The commercial device was modified for use with the present invention by enlarging the sample holder portion to facilitate insertion and extraction of article 20 by robot 503. In accordance with the present invention, robot 503 grips article 20 and maneuvers to insert article 20 axially into the sample holder to a selected depth based on the previously encoded nominal length of article 20 (not shown), whereupon microprocessor 1000 sends a command to device 600 instructing device 600 to read the circumference. Article 20 is then rotated through one revolution as conventional laser measuring techniques are used to take 200 measurements of the diameter of article 20. Device 600 then calculates the circumference of article 20 from the average of the diameter measurements. This data is communicated to microprocessor 1000 and stored, optionally in host computer 1200, for subsequent tabulation and analysis. Following the conclusion of the measurement, robot 503 extracts article 20 from the sample holder and advances it to the next station, in accordance with the program for processing that particular article 20.

PDI station 700 measures the pressure drop and filter ventilation of one article 20 at a time. Station 700 is secured at a fixed location on table 12 within the reach of robot 503. Station 700 is preferably a commercial device, model PDI/ODI available from Fidus Corporation, Richmond, Va. The commercial device is normally manually operated. For use with the present invention, the device was modified to install conventionally a suitable number of solenoids and relays so that microprocessor 1000 could control the "manual" operation of the instrument. Thus, to operate the instrument, microprocessor 1000 issues appropriate instructions first to robot 503 to manipulate one article 20 and to insert or release article 20 into the commercial receiving portion of the instrument, and, second, to actuate the relays to drive the solenoids thereby to conduct normally the pressure drop and ventilation measurement procedures. Similarly, microprocessor 1000 is connected to the data port of the instrument so that the measurements obtained are communicated to microprocessor 1000 for recordation and tabulation. Following the measurement procedures, microprocessor 1000 controls the instrument to eject the article 20 to the receiving portion, whereupon robot 503 is instructed to grip again article 20 and maneuver it to the next station, in accordance with the program for processing that particular article 20.

PDI station 800 measures the filter pressure drop of one filter rod portion 450 at a time. Station 800 is secured at a fixed location on table 12 within the reach of robot 503. Station 800 is preferably a commercial device, model PDI available from Fidus Corporation, Richmond, Va. The commercial device is normally manually operated. For use with the present invention, the device was modified to install a suitable number of solenoids and relays in a conventional manner so that microprocessor 1000 could control the "manual" operation of the instrument. Thus, to operate the instrument, microprocessor 1000 issues appropriate instructions first to robot 503 to manipulate filter rod portion 450 and to release or insert filter 450 into the commercial receiving portion of the instrument, and, second, to actuate the relays to drive the solenoids thereby to conduct normally the filter pressure drop measurement. Similarly, microprocessor 1000 is connected to the data port of the instrument so that the measurement obtained is communicated to microprocessor 1000 for recordation and tabulation. Following the measurement procedure, microprocessor 1000 controls the instrument to eject the filter portion 450 to a trash receptacle.

Station 850 measures the filter length of a filter rod portion 450 one at a time. Station 850 is secured at a fixed location on table 12 within the reach of robot 503. Station 850 is preferably a commercial device, model EG-250 available from Ono Sokki Co., Ltd., Tokyo Japan. The commercial device is a digital linear gauge for measuring thicknesses between a movable tip and a fixed base (not shown) having a data communications port for providing measured data and is normally manually operated. For use with the present invention, the device was modified to install an air cylinder and a solenoid in a conventional manner so that microprocessor 1000 could control the "manual" operation of the instrument, specifically the movement of the tip relative to the base. Thus, to operate the instrument, microprocessor 1000 issues appropriate instructions to robot 503 to manipulate filter rod portion 450 in axial alignment between the tip and the base of the commercial receiving portion of the instrument, and to the solenoid and air cylinder to move the tip to engage the aligned filter portion to conduct the filter length measurement and then to release the filter. Similarly, microprocessor 1000 is connected to the data port of the instrument so that the measurement obtained is communicated to microprocessor 1000 for recordation and tabulation. Following the measurement, microprocessor 1000 instructs robot 503 to grip filter 450, then controls the solenoid and air cylinder and the tip is retracted from the base so that filter portion 450 is removed by robot 503 and maneuvered to the next station, in accordance with the program for processing that particular filter portion 450.

The data collected by microprocessor 1000 are typically transferred to a controller or host computer 1200 for processing. Computer 1200, includes a PC/286 microprocessor device, a model SUN SPARCstation available from Sun Microsystems, Inc. and a conventional database computer. An Ethernet network (not shown) links microprocessor 1000, computer 1200 and the various test instruments for communications therebetween.

Referring to FIG. 1, barcode reader 1300 is connected to computer 1200 for entering sample identification codes for each sample set of a plurality of like articles 20 and creating a database file of the pertinent data regarding the nominal dimensions and characteristics of the articles in that sample. The sample set is inserted into a designated hopper 110 of hopper feeder 100 which is correlated to the bar code given. Database files are shared by computer 1200 and microprocessor 1000 and stored on a software disk that is accessible over the Ethernet network.

Test station 10 in accordance with the present embodiment can test filtered or non-filtered cigarettes and other types of smoking articles having circumferences in the range of 22 to 25 mm and nominal lengths of 80 to 120 mm. Use of the hopper feeder device 100 provides a plurality of hoppers 110, e.g., eighteen, to be filled, each hopper 110 holding up to 30 cigarettes in a given sample set. In the preferred embodiment, test station 10 can be programmed to measure any of article pressure drop, filter ventilation, filter pressure drop, circumference, cigarette length, and filter length on any number of plurality of articles in each sample set in any sequence, provided that tests on a complete article are completed before tests are conducted on a component severed from that article.

Operation of test station 10 in accordance with the present invention begins when the operator loads a sample set into hopper feeder 100, provides the sample set with an identifying bar code, and creates a test sequence database file for that set in one of host computer 1200 or microprocessor 1000. The database file typically includes the number of articles 20 in the sample set, the nominal length of the articles and their filter portions and other pertinent dimensions of the articles or their components and the test protocol for that sample set, i.e., which tests are to be performed on how many of the articles in that sample set. This information is then logged in microprocessor 1000 or computer 1200 by the operator, at operator workstation 1100, as each sample set is deposited into a designated hopper 110.

The operator can continue loading the system with up to eighteen samples, each sample having a bar code and an associated database. For example, a typical sample set will have twenty-five articles. The operator may instruct that each article will be measured for article length, circumference, and pressure drop, and for filter ventilation, pressure drop, and length. Alternately, the operator may instruct that only ten of the twenty-five articles will be measured for article length and circumference and filter length, and all twenty-five of the articles will be measured for article pressure drop, filter ventilation, and filter pressure drop. In this regard, robot 503 will not maneuver the other fifteen articles to those stations not selected.

In an alternate embodiment, with appropriate software and memory capacity, it may be possible for the operator to program station 10 with a particular order for testing the articles in each sample set, such that the selected ten tests for article length will be taken off the first five articles and the last five articles, whereas the ten tests for filter length will be taken off alternating filter rod portions. Other combinations thus could be created as desired.

preferably, computer 1200 is used to write the selected barcodes into a "worklist" file that will be used by microprocessor 1000. After entry of the last test specification, the operator moves to microprocessor 1000 and answers software generated questions which define the station's operating mode. Microprocessor 1000 initializes robot 503 and verifies that the communications network is operational. It then waits for the operator to enter the command, at operator workstation 1100, to actually start sample testing. After entering this start command, the operator is then free to perform other tasks.

Microprocessor 1000 transfers the barcode worklist and database specification files from computer 1200 data disk, reads the first barcode from the worklist, extracts the selected test requirements from the corresponding specification file and displays this information on a monitor (e.g., at operator workstation 1100) for operator observation.

A sample of cigarettes from hopper 110 is fed into feeding device 140. The first cigarette is fed from device 140 onto and down chute 220 so that it comes to rest against stop 222 with filter end 450 down, where its length is measured by camera 230. Robot 503 picks up the cigarette by the tobacco end at a distance of about 65 mm from the filter end, rotates it to a filter end up position and sequences it through, for example, station 700 which obtains the article pressure drop and ventilation measurement and station 600 which obtains the article circumference measurement as called for in the specification file. Microprocessor 1000 operates each instrument, reads and records the data, and displays the test values on the system monitor. If no further tests are to be conducted, robot 503 may move article 20 to a waste receptacle.

For conducting subsequent tests on filter portion 450, robot 503 retrieves article 20 from the last smoking article test station and places and releases article 20 in reorientation fixture 900. Robot 503 then moves hand 500 to rotate and grip article 20 by the filter end. The cigarette is placed in the severing station 300 and filter 450 is cut approximately two mm longer than the nominal length obtained from the specification file. The sheared tobacco rod drops through a chute and into a trash receptacle (not shown). Robot 503 then takes filter 450 to deshredding station 400, where any remaining tobacco is dislodged and vacuumed into a holding tank.

Robot 503 then sequences the filter 450 through stations 850 and 800 for measuring the filter length and filter pressure drop (or vice versa) as indicated in the specification file. The filter pressure drop test is preferably conducted last. Accordingly, following the measurement, a blast of air blows filter 450 out of the instrument, into a chute which leads to a trash receptacle (not shown). Test station microprocessor 1000 operates each instrument, collects and records the data and displays the data obtained from these instruments on the system monitor.

After all cigarettes in the sample set have been tested, the accumulated data are transmitted in a test data file to host computer 1200. It has been found that it requires approximately thirty minutes to run a sample of 25 cigarettes through the full compliment of tests.

The next sample set in the following hopper 110 is then unloaded into device 140, the bar code and corresponding database file of parameters obtained, and the specified test sequence for the samples in that set is run. This procedure is repeated until the last sample set has been tested. When the data for the final sample set in the worklist have been transmitted, microprocessor 1000 searches host computer 1200 for another worklist. Additional sample sets can be loaded into hopper feeder 110 and a second worklist containing barcodes having corresponding databases can be created in host computer 1200. If such a second worklist is found, it is transferred to microprocessor 1000 and the testing continues; otherwise, robot 503 is moved to its rest position.

The test station of the present invention has a flexible design for optimal use. If host computer 1200 fails, the necessary coding and parameter entry can be entered directly into microprocessor 1000. The data are stored in microprocessor 1000 and sent to the host computer 1200 when communications have been restored. If hopper feeder 100 is not functional, sample sets can be loaded by hand into feeder mechanism 140.

The operator also can bypass a faulty instrument by not requesting a specific test in the test specification file of the database. The operator also may use the test instruments manually, for example, if the robot is not operational or only a select few tests are required. This may be accomplished by inserting a cigarette into an instrument, manually activating the instrument to conduct the test, and instructing microprocessor 1000 when to read the data obtained by the instrument. The data are typically saved in microprocessor 1000 and sent to host computer 1200 when the testing is completed.

Test station 10 also looks for operational problems while it is running, such as a cigarette not feeding from the hopper, an instrument blocked by a previously tested cigarette/filter, or a cigarette not being properly placed into an instrument. When one of these situations is detected, test station 10 tries to correct the problem. The station operating mode specified by the operator determines how test station 10 reacts if it is unable to correct the problem.

When microprocessor 1000 is operating in a mode having an operator in the area and it is unable to correct automatically a problem, it signals the operator that a problem has occurred, stops robot 503 and requests the operator to correct the problem and restart the operation. When restarted, operation resumes where the problem was detected.

When operating in an unattended mode and microprocessor 1000 is unable to correct the problem, it bypasses the problem instrument and goes to the next instrument in the test sequence. Microprocessor 1000 also loads an appropriate failure message into a log file which is transmitted to host computer 1200 along with the test data. This file may be used later to determine what caused the problem.

EXAMPLE

A test station in accordance with the preferred embodiment described above was constructed using the instruments described above. Its operation was compared to a manually operated test station using the same type of instruments.

Three different brands, whose lengths range from 84 to 120 mm, were tested for comparison of data acquired by the robotic test station of the present invention and by the manual procedure using the conventional instruments. Two sets of samples were taken from the same population of cigarettes; one set was run on the robotic test station and the second set was run on manually operated instruments. Comparisons were made for cigarette length and circumference, total pressure drop, filter ventilation, filter length and filter pressure drop. The results, which are set forth in Tables I–VI, show that the differences between the robotic test station and the manually operated instruments are less than the standard deviations of the methods.

TABLE I

| Brand | | Total Pressure Drop, mm of $H_2O$ Robot | Manual | Difference, Δ |
|---|---|---|---|---|
| Sample A | $\bar{\kappa}$ | 126.2 | 127.0 | 0.8 |
| | $\sigma$ | 6.2 | 7.6 | |
| Sample B | $\bar{\kappa}$ | 120.2 | 120.4 | 0.2 |
| | $\sigma$ | 4.7 | 4.3 | |
| Sample C | $\bar{\kappa}$ | 133.9 | 135.7 | 1.8 |
| | $\sigma$ | 4.7 | 6.3 | |

TABLE II

| Brand | | Filter Pressure Drop, mm of $H_2O$ Robot | Manual | Difference, Δ |
|---|---|---|---|---|
| Sample A | $\bar{\kappa}$ | 68.9 | 68.8 | 0.1 |
| | $\sigma$ | 2.9 | 3.3 | |
| Sample B | $\bar{\kappa}$ | 99.0 | 100.5 | 1.5 |
| | $\sigma$ | 5.1 | 4.2 | |
| Sample C | $\bar{\kappa}$ | 103.0 | 100.9 | 2.1 |
| | $\sigma$ | 5.1 | 4.5 | |

TABLE III

| Brand | | Filter Length, mm Robot | Manual | Difference, Δ |
|---|---|---|---|---|
| Sample A | $\bar{\kappa}$ | 26.54 | 26.83 | 0.29 |
| | $\sigma$ | 0.12 | 0.21 | |
| Sample B | $\bar{\kappa}$ | 26.74 | 26.68 | 0.06 |
| | $\sigma$ | 0.14 | 0.18 | |
| Sample C | $\bar{\kappa}$ | 31.25 | 31.38 | 0.13 |
| | $\sigma$ | 0.32 | 0.28 | |

TABLE IV

| Brand | | Circumference, mm Robot | Manual | Difference, Δ |
|---|---|---|---|---|
| Sample A | $\bar{\kappa}$ | 24.78 | 24.91 | 0.13 |
| | $\sigma$ | 0.10 | 0.09 | |
| Sample B | $\bar{\kappa}$ | 24.95 | 24.89 | 0.06 |
| | $\sigma$ | 0.10 | 0.09 | |
| Sample C | $\bar{\kappa}$ | 23.12 | 23.11 | 0.01 |
| | $\sigma$ | 0.04 | 0.09 | |

TABLE V

| Brand | | Cigarette Length, mm Robot | Manual | Difference, Δ |
|---|---|---|---|---|
| Sample A | $\bar{\kappa}$ | 99.05 | 98.89 | 0.16 |
| | $\sigma$ | 0.21 | 0.54 | |
| Sample B | $\bar{\kappa}$ | 83.92 | 83.89 | 0.03 |
| | $\sigma$ | 0.22 | 0.27 | |
| Sample C | $\bar{\kappa}$ | 119.64 | 119.59 | 0.05 |
| | $\sigma$ | 0.18 | 0.19 | |

TABLE VI

| Brand | | Ventilation, % Robot | Manual | Difference, Δ |
|---|---|---|---|---|
| Sample A | $\bar{\kappa}$ | 0.0 | 0.0 | 0.0 |
| | $\sigma$ | 0.0 | 0.0 | |
| Sample B | $\bar{\kappa}$ | 21.3 | 22.1 | 0.8 |
| | $\sigma$ | 2.1 | 2.3 | |
| Sample C | $\bar{\kappa}$ | 26.4 | 26.4 | 0.0 |
| | $\sigma$ | 1.7 | 1.9 | |

Although the robotic test station requires about twice the time to process samples as the manually operated station, it facilitates continuous and consistent handling of cigarettes and filters and is capable of running a full compliment of tests on 36 sample sets of 25 articles per day. It also provides for assured testing of smoking articles and filters from these article, an improved characterization of the samples, and can operate unattended. Improvements in speed could be obtained by selection of a different robot device and spacing of the various test stations.

One skilled in the art will appreciate that the present invention can be practiced by other than the described embodiments, which are presented for purposes of illustration and not of limitation, and the present invention is limited only by the claims which follow.

We claim:

1. Apparatus for measuring a physical characteristic of a plurality of smoking articles, comprising:

means for gripping and releasing a smoking article;

means for maneuvering a gripped smoking article within a range of motion;

means for receiving one of said plurality of smoking articles at a first location within the range of motion;

means for measuring a physical characteristic of a smoking article, the measuring means being at a second location within the range of motion; and microprocessor means for controlling the gripping and releasing means and the maneuvering means to grip the one smoking article at the first location, to maneuver the one smoking article to the measuring means, to release the one smoking article at the measuring means so that the physical characteristic of the one smoking article can be measured and to grip again the one smoking article at the measuring means following the measurement.

2. The apparatus of claim 1 wherein the gripping and releasing means and the maneuvering means further comprises a robot having a first member and a second member, the first and second member being movable in opposition for gripping therebetween a smoking article.

3. The apparatus of claim 1 wherein the measuring means further comprises a first means for measuring a first physical characteristic of a smoking article located at the second location and a second means for measuring a second physical characteristic of a smoking article, the second measuring means being located at a third location within the range of motion, and wherein the controlling means controls the gripping and releasing means and the maneuvering means to grip the one smoking article at the first location and to maneuver the one smoking article to one of the first and second measuring means whereby one of the first and second physical characteristics can be measured.

4. The apparatus of claim 3 wherein the controlling means controls the gripping and releasing means and the maneuvering means to maneuver the one smoking article from the one of the first and second measuring stations to the other of the first and second measuring means whereby the other of the first and second physical characteristics can be measured.

5. The apparatus of claim 1 wherein the measuring means further comprises more than one means for measuring more than one selected physical characteristic of a smoking article wherein each said means is located at a different location within the range of motion, said means being selected from among the group consisting of means for measuring circumference, means for measuring ventilation, means for measuring pressure drop and means for measuring length, and wherein the controlling means controls the gripping and releasing means and the maneuvering means to maneuver the one smoking article to one or more of the measuring means.

6. The apparatus of claim 5 wherein the controlling means further comprises a means for providing a test sequence identifying one or more physical characteristics of the one smoking article to be measured, wherein the controlling means is responsive to the test sequence and controls the gripping and releasing means and the maneuvering means to maneuver the gripped one smoking article to one or more of the measuring means so that the one or more identified physical characteristics can be measured.

7. The apparatus of claim 6 wherein the test sequence identifies the order in which the measurements of the one smoking article are to be made.

8. The apparatus of claim 6 wherein the test sequence identifies the order in which the measurements of each smoking article in the plurality of smoking articles are to be made.

9. In a test station having a means for gripping and releasing a smoking article, means for maneuvering a gripped smoking article within a range of motion, means for receiving one of said plurality of smoking articles at a first location within the range of motion, means for measuring a physical characteristic of a smoking article, the measuring means being at a second location within the range of motion; and microprocessor means for controlling the gripping and releasing means and the maneuvering means, a method for measuring a physical characteristic of a plurality of smoking articles, comprising:

providing a plurality of smoking articles;

feeding one smoking article to the receiving means;

gripping the one fed smoking article at the receiving means;

maneuvering the gripped one smoking article to the measuring means;

releasing the one smoking article at the measuring means;

measuring the physical characteristic of the one smoking article; and gripping again the one smoking article at the measuring means following the measurement.

10. The method of claim 9 wherein the gripping and releasing means and the maneuvering means further comprise a robot having a first member and a second member being movable in opposition, and gripping and releasing the one smoking article further comprises moving the first and second members together for gripping a smoking article and moving the first and second members apart to release the smoking article.

11. The method of claim 9 wherein the test station includes more than one means for measuring more than one selected physical characteristic of a smoking article wherein each said means is located at a different location within the range of motion, said means being selected from among the group consisting of means for measuring circumference, means for measuring ventilation and pressure drop and means for measuring length, the method further comprising:

providing a test sequence identifying one or more physical characteristics of the one smoking article to be measured;

gripping and maneuvering the one smoking article to one or more of the measuring means in response to the provided test sequence so that the one or more identified physical characteristics can be measured.

12. The method of claim 11 wherein providing the test sequence further comprises identifying the order in which the measurements of the one smoking article are to be made.

13. The method of claim 11 wherein providing the test sequence further comprises identifying the order in which the measurements of each smoking article in the plurality of smoking articles are to be made.

14. Apparatus for measuring a physical characteristic of a component of a plurality of smoking articles, comprising:

means for gripping and releasing a smoking article;

means for maneuvering a gripped smoking article within a range of motion;

means for receiving one of said plurality of smoking articles at a first location within the range of motion;

means for severing the component of the smoking article from the smoking article, the severing means being located at a second location within the range of motion;

means for measuring a physical characteristic of a smoking article component, the measuring means being at a third location within the range of motion; and microprocessor means for controlling the gripping and releasing means and the maneuvering means to grip the one smoking article at the first location and maneuver the one smoking article to the severing means, to maneuver the one smoking article component to the measuring means, to release the one smoking article component at the measuring means so that the physical characteristic of the one smoking article component can be measured, and to grip the one smoking article component at the measuring means following the measurement.

15. The apparatus of claim 14 wherein the gripping and releasing means and the maneuvering means further comprise a robot having a first member and a second member, the first and second members being movable in opposition for gripping therebetween a smoking article.

16. The apparatus of claim 14 further wherein the measuring means comprises a first measuring means for measuring a first physical characteristic of a smoking article component located at the third location and a second means for measuring a second physical characteristic of a smoking article component, the second measuring means being located at a fourth location within the range of motion, and wherein the controlling means controls the gripping and releasing means and the maneuvering means to grip and maneuver the one smoking article component to one of the first and second measuring means whereby one of the first and second physical characteristics can be measured.

17. The apparatus of claim 16 wherein the controlling means controls the gripping and releasing means and the maneuvering means to maneuver the one smoking article component from the one of the first and second measuring stations to the other of the first and second measuring means whereby the other of the first and second physical characteristics of the smoking article component can be measured.

18. The apparatus of claim 17 wherein the first and second measuring means are selected from among the group consisting of means for measuring pressure drop and means for measuring length.

19. The apparatus of claim 19 wherein the controlling means further comprises a means for providing a test sequence identifying one or more physical characteristics of the one smoking article component to be measured, wherein the controlling means is responsive to the provided test sequence and controls the gripping and releasing means and the maneuvering means to maneuver the gripped one smoking article to one or both of the first and second measuring means so that the one or both identified physical characteristics of the smoking article component can be measured.

20. The apparatus of claim 19 wherein the test sequence identifies the order in which the measurements of the one smoking article component are to be made.

21. The apparatus of claim 19 wherein the test sequence identifies the order in which the measurements of each smoking article component of the plurality of smoking article are to be made.

22. The apparatus of claim 14, wherein the measuring means further comprises a first means for measuring a first physical characteristic of a smoking article component and a second means for measuring a first physical characteristic of a smoking article, the second measuring means being at a fourth location within the range of motion, wherein the controlling means controls the gripping and releasing means and the maneuvering means to grip the one smoking article at the first location, to maneuver the one smoking article to the second measuring means so that the first physical characteristic of the one smoking article can be measured, and then to the severing means, thereby to sever he component, and to maneuver the one smoking article component to the first measuring means so that the first physical characteristic of the one smoking article component can be measured.

23. The apparatus of claim 22 wherein the first measuring means further comprises more than one means for measuring more than one physical characteristic of a smoking article component at more than one location in the range of motion, the second measuring means further comprises more than one means for measuring more than one physical characteristic of a smoking article located at more than one location in the range of motion, and the controlling means further comprises a means for providing a test sequence identifying one or more physical characteristics of the one smoking article and one or more physical characteristics of the one smoking article component to be measured, wherein the controlling means is responsive to the provided test sequence and controls the gripping and releasing means and the maneuvering means to maneuver the gripped one smoking article to one or more of the second measuring means, and the severing means and one or more of the first measuring means so that the one or more identified physical characteristics of the smoking article and the smoking article component can be measured.

24. The apparatus of claim 23 wherein the test sequence identifies the order in which the measurements of the one smoking article and the one smoking article component are to be made whereby the physical characteristics of the one smoking article are obtained prior to the physical characteristics of the one smoking article component.

25. The apparatus of claim 23 wherein the test sequence identifies the order in which the measurements of each smoking article and smoking article component of the plurality of smoking articles are to be made whereby the physical characteristics of each one smoking article are obtained prior to the physical characteristics of the one smoking article component.

26. The apparatus of claim 22 further comprising a second means for receiving a smoking article at a fifth location within the range of motion wherein the controlling means controls the gripping and releasing means and the maneuvering means to release the one smoking article onto the second receiving means and then to grip the smoking article by its component on the second receiving means, to maneuver the one smoking article to the severing means, and to grip the one smoking article component during the severing process.

27. The apparatus of claim 14 wherein the smoking article component is a filter rod of a cigarette, the apparatus further comprising means for deshredding the severed filter component of a cigarette, wherein the controlling means controls the gripping and releasing means and the maneuvering means to maneuver a severed filter to the deshredding means following the severing operation.

28. In a test station having means for gripping and releasing a smoking article, means for maneuvering a gripped smoking article within a range of motion, means for receiving one of said plurality of smoking articles at a first location within the range of motion, means for severing a component of a smoking article from the smoking article, the severing means being located at a second location within the range of motion, means for measuring a physical characteristic of a smoking article component, the measuring means being at a third location within the range of motion, and microprocessor means for controlling the gripping and releasing means and the maneuvering means, a method for measuring a physical characteristic of a component of a plurality of smoking articles comprising:

providing a plurality of smoking articles;

feeding one smoking article to the receiving means;

gripping the one fed smoking article by its component;

maneuvering the gripped smoking article to the severing means;

severing the one smoking article component from the one smoking article;

maneuvering the one smoking article component to the measuring means;

releasing the smoking article component at the measuring means;

measuring the physical characteristic of the one smoking article; and gripping again the one smoking article component at the measuring means following the measurement.

29. The method of claim 28 wherein the gripping and releasing means and the maneuvering means further comprise a robot having a first member and a second member movable in opposition and wherein gripping the one smoking article or one smoking article component further comprises moving the first and second members together and releasing the one smoking article component further comprises moving the first and second members apart.

30. The method of claim 29 wherein the measuring means further comprises one or more means for measuring one or more physical characteristics of a smoking article component selected from among the group consisting of means for measuring pressure drop and means for measuring length, and one or more means for measuring one or more physical characteristics of a smoking article, each measuring means being located at a different location within the range of motion, the method further comprising:

providing a test sequence identifying one or more of the physical characteristics of the one smoking article and the one smoking article component to be measured;

gripping and releasing and maneuvering the one smoking article to one or more of the measuring means and the severing station in response to the identified sequence so that the one or more of the identified physical characteristics of the one smoking article and the one smoking article component can be measured.

31. The method of claim 30 wherein providing the test sequence further comprises identifying the order in which the measurements of the one smoking article and the one smoking article component are to be made.

32. The method of claim 30 wherein providing the test sequence further comprises identifying the order in which the measurements of each smoking article and smoking article component of the plurality of smoking articles are to be made.

33. The method of claim 30 wherein the test station includes a second means for receiving a smoking article at a fourth location within the range of motion and wherein maneuvering the gripped one smoking article to the severing means further comprises:

maneuvering the gripped article to the second receiving means, releasing the one smoking article on the second receiving means;

gripping the one smoking article component while the one smoking article is on the second receiving means; and maneuvering the one smoking article to the severing means so that the gripping means grips the one smoking article component during the severing process.

34. The method of claim 33 wherein the smoking article and its component further comprise a cigarette having a tobacco-containing rod and a filter, respectively, the method further comprising:

maneuvering the gripped filter severed from the cigarette to a means for deshredding the filter of any tobacco prior to measuring the physical characteristic of the filter, the deshredding means being at a fifth location in the range of motion.

* * * * *